US006362409B1

(12) United States Patent
Gadre

(10) Patent No.: US 6,362,409 B1
(45) Date of Patent: Mar. 26, 2002

(54) CUSTOMIZABLE SOFTWARE-BASED DIGITAL WAVETABLE SYNTHESIZER

(75) Inventor: Sharadchandra H. Gadre, Seattle, WA (US)

(73) Assignee: IMMS, Inc., Seattle, WA (US)

( * ) Notice: Subject to any disclaimer, the term of this patent is extended or adjusted under 35 U.S.C. 154(b) by 0 days.

(21) Appl. No.: 09/449,045

(22) Filed: Nov. 24, 1999

Related U.S. Application Data

(60) Provisional application No. 60/110,610, filed on Dec. 2, 1998.

(51) Int. Cl.[7] ..... G10H 7/00

(52) U.S. Cl. ..... 84/603; 84/616; 84/622; 84/659

(58) Field of Search ..... 84/600–607, 609, 84/615–616, 622–629, 645, 649, 653–654, 659–660, 662–663

(56) References Cited

U.S. PATENT DOCUMENTS

| | | | | |
|---|---|---|---|---|
| 4,622,877 A | | 11/1986 | Strong | 84/1.01 |
| 4,649,783 A | | 3/1987 | Strong et al. | 84/1.01 |
| 4,966,053 A | | 10/1990 | Dornes | 84/718 |
| 4,998,960 A | | 3/1991 | Rose et al. | 84/622 |
| 5,054,360 A | | 10/1991 | Lisle et al. | 84/645 |
| 5,092,216 A | | 3/1992 | Wadhams | 84/602 |
| 5,131,042 A | | 7/1992 | Oda | 381/34 |
| 5,148,330 A | | 9/1992 | Duurland et al. | 360/40 |
| 5,191,319 A | | 3/1993 | Kiltz | 340/701 |
| 5,243,123 A | | 9/1993 | Chaya | 84/609 |
| 5,243,470 A | | 9/1993 | Duurland et al. | 360/15 |
| 5,278,346 A | | 1/1994 | Yamaguchi | 84/609 |
| 5,306,865 A | | 4/1994 | Dinnan et al. | 84/622 |
| 5,371,634 A | | 12/1994 | Duurland et al. | 360/15 |
| 5,376,752 A | | 12/1994 | Limberis et al. | 84/622 |
| 5,402,339 A | | 3/1995 | Nakashima et al. | 364/419.19 |
| 5,536,902 A | * | 7/1996 | Serra et al. | 84/623 |
| 5,541,354 A | | 7/1996 | Farrett et al. | 84/603 |
| 5,574,243 A | | 11/1996 | Nakai et al. | 84/609 |
| 5,619,002 A | | 4/1997 | Walck | 84/603 |
| 5,619,004 A | | 4/1997 | Dame | 811/616 |
| 5,627,335 A | | 5/1997 | Rigopulos et al. | 84/635 |
| 5,629,867 A | | 5/1997 | Goldman | 364/514 R |
| 5,636,276 A | | 6/1997 | Brugger | 380/4 |
| 5,642,470 A | | 6/1997 | Yamamoto et al. | 395/2.79 |
| 5,659,466 A | | 8/1997 | Norris et al. | 364/400.01 |
| 5,668,336 A | | 9/1997 | Miyano | 84/605 |

(List continued on next page.)

*Primary Examiner*—Marlon T. Fletcher
(74) *Attorney, Agent, or Firm*—Seed IP Law Group, PLLC

(57) ABSTRACT

A software based digital wavetable synthesizer receives musical data from an external source and generates a plurality of digital sample values corresponding to the musical source. The musical source may be a synthesized music source or an actual instrument. In an exemplary embodiment, a sample for each semi-tone for the musical instrument is sampled and stored. A subsequent process analyzes the sampled and selects a single cycle representing that musical instrument at each of the semi-tones. The data is subsequently normalized such that each cycle begins with a zero value and the normalized data is stored in a data structure along with labels indicative of the musical instrument and the musical note. In subsequent use, the user can create synthesized music by selecting the desired instrument and notes. Additional musical rules, such as rules associated with Indian classical music, may be applied to specify the synthesis process. The musical notes, generated in accordance with the associated musical rules are provided to a music output file, which may be converted into a conventional waveform format and played on a conventional sound card. The invention is totally software based and does not rely on synthesized data stored in firmware or hardware on a special musical synthesizer card. Instead, any conventional sound card may be readily used thus allowing portability of the music synthesizer between computing platforms.

26 Claims, 27 Drawing Sheets

U.S. PATENT DOCUMENTS

| | | | | |
|---|---|---|---|---|
| 5,668,338 | A | 9/1997 | Hewitt et al. | 84/629 |
| 5,689,080 | A | 11/1997 | Gulick | 84/604 |
| 5,690,496 | A | 11/1997 | Kennedy | 434/307 R |
| 5,698,802 | A | 12/1997 | Kamiya | 84/604 |
| 5,714,703 | A | 2/1998 | Wachi et al. | 84/603 |
| 5,717,154 | A | 2/1998 | Gulick | 84/604 |
| 5,744,739 | A | 4/1998 | Jenkins | 84/603 |
| 5,750,911 | A | 5/1998 | Tamura | 84/602 |
| 5,763,801 | A | 6/1998 | Gulick | 84/604 |
| 5,770,812 | A | 6/1998 | Kitayama | 84/603 |
| 5,864,080 | A * | 1/1999 | O'Connell | 84/622 |

* cited by examiner

| | | | | |
|---|---|---|---|---|
| 185, | -679, | -1500, | -2206, | -2759, |
| -3125, | -3313, | -3332, | -3246, | -3075, |
| -2847, | -2593, | -2301, | -2002, | -1706, |
| -1443, | -1250, | -1170, | -1262, | -1529, |
| -1955, | -2492, | -3057, | -3558, | -3920, |
| -4083, | -4012, | -3731, | -3292, | -2799, |
| -2359, | -2063, | -1985, | -2137, | -2461, |
| -2924, | -3426, | -3875, | -4204, | -4381, |
| -4404, | -4281, | -4068, | -3821, | -3557, |
| -3328, | -3173, | -3076, | -3038, | -3038, |
| -3058, | -3082, | -3110, | -3126, | -3128, |
| -3121, | -3093, | -3022, | -2922, | -2808, |
| -2670, | -2495, | -2297, | -2089, | -1843, |
| -1595, | -1359, | -1161, | -1024, | -966, |
| -1007, | -1136, | -1328, | -1530, | -1678, |
| -1707, | -1594, | -1296, | -797, | -133, |
| 650, | 1525, | 2395, | 3184, | 3845, |
| 4323, | 4625, | 4731, | 4677, | 4511, |
| 4243, | 3914, | 3541, | 3136, | 2742, |
| 2400, | 2171, | 2112, | 2267, | 2630, |
| 3171, | 3800, | 4417, | 4907, | 5172, |
| 5164, | 4885, | 4383, | 3783, | 3223, |
| 2819, | 2675, | 2819, | 3237, | 3854, |
| 4553, | 5201, | 5664, | 5898, | 5866, |
| 5592, | 5165, | 4696, | 4268, | 3960, |
| 3822, | 3853, | 4019, | 4243, | 4475, |
| 4652, | 4722, | 4690, | 4547, | 4329, |
| 4086, | 3853, | 3670, | 3567, | 3528, |
| 3550, | 3581, | 3577, | 3516, | 3374, |
| 3162, | 2880, | 2600, | 2357, | 2194, |
| 2149, | 2207, | 2337, | 2497, | 2621, |
| 2651, | 2537, | 2215, | 1690, | 995, |
| 176, | -695, | | | |

*Fig. 5*

Note Specifications: Table

| Instr Name | Note Id | SamPerCyc | Fractional Value | CycPerSec |
|---|---|---|---|---|
| C | 5 | 241 | 0.6 | 182.98755186722 |
| C | 6 | 225 | 0.6 | 196 |
| C | 7 | 214 | 0.5 | 206.07476635514 |
| C | 8 | 201 | 1 | 217.241379310345 |
| C | 9 | 191 | 1 | 232.105263157895 |
| C | 10 | 180 | 0.9 | 243.646408839779 |
| C | 11 | 168 | 1 | 260.94674556213 |
| C | 12 | 160 | 1 | 275.625 |
| C | 13 | 151 | 0.2 | 294 |
| C | 14 | 143 | 0.5 | 308.391608391608 |
| C | 15 | 136 | 0.5 | 326.666666666667 |
| C | 16 | 128 | 1 | 344.53125 |
| C | 17 | 121 | 0.2 | 367.5 |
| C | 18 | 113 | 0.5 | 390.265486725664 |
| C | 19 | 107 | 0.6 | 416.037735849057 |
| C | 20 | 102 | 0.9 | 432.352941176471 |

*Fig. 12*

Sample Values: Table

| Instr Name | Note Id | Sample Id | Sample Value |
|---|---|---|---|
| C | 11 | 166 | 2294 |
| C | 11 | 167 | 1125 |
| C | 11 | 168 | 335 |
| C | 11 | 169 | 543 |
| C | 12 | 1 | 0 |
| C | 12 | 2 | -1388 |
| C | 12 | 3 | -2736 |
| C | 12 | 4 | -3928 |
| C | 12 | 5 | -4892 |
| C | 12 | 6 | -5565 |
| C | 12 | 7 | -5962 |
| C | 12 | 8 | -6083 |
| C | 12 | 9 | -5943 |
| C | 12 | 10 | -5626 |
| C | 12 | 11 | -5160 |
| C | 12 | 12 | -4563 |
| C | 12 | 13 | -3904 |

Record: 1 of 9273

*Fig. 13*

| ALGORITHM NUMBER | ALGORITHM DEFINITION | FIGURE NUMBER | SECTION NUMBER |
|---|---|---|---|
| ALGORITHM 1.1 | ALGORITHM FOR NORMALIZING RECORDED SINGLE CYCLE SAMPLES | FIG. 16 | 1.2.4 |
| ALGORITHM 1.2 | ALGORITHM FOR CREATING MUSIC WAVEFORM FILES | | 1.3.1 |
| ALGORITHM 1.3 | ALGORITHM FOR CREATING 'ATTACK' SECTION OF A NOTE | FIG. 17 | 1.3.2.2 |
| ALGORITHM 1.4 | ALGORITHM FOR CREATING 'DECAY' SECTION OF A NOTE | FIG. 18 | 1.3.2.2 |
| ALGORITHM 1.5 | ALGORITHM FOR PRODUCING QUARTER TONES | FIG. 22 | 1.4.5.1 |
| ALGORITHM 1.6 | ALGORITHM FOR CREATING FULLY OVERLAPPED TRANSITION BETWEEN NOTES | FIG. 23 | 1.4.6.2 |
| ALGORITHM 1.7 | ALGORITHM FOR PRODUCING GLIDE FROM ONE NOTE TO ANOTHER NOTE | FIG. 24 | 1.4.6.3 |
| ALGORITHM 1.8 | ALGORITHM FOR PRODUCING OSCILLATORY PATTERNS BETWEEN TWO NOTES | | 1.4.7.1 |
| ALGORITHM 1.9 | ALGORITHM FOR PRODUCING THE DRONE ACCOMPANIMENT | FIG. 25 | 1.4.8.1 |
| ALGORITHM 1.10 | ALGORITHM FOR PRODUCING THE RHYTHMIC ACCOMPANIMENT | | 1.4.10 |

*Fig. 27*

CUSTOMIZABLE SOFTWARE-BASED DIGITAL WAVETABLE SYNTHESIZER

CROSS-REFERENCE TO RELATED APPLICATION

This application claims the benefit of U.S. Provisional Patent Application No. 60/110,610, entitled "MUSIC METHOD AND SYSTEM," filed Dec. 2, 1998.

FIELD OF THE INVENTION

The present invention 'relates' generally to music synthesizers, and more particularly, to a customizable, software-based digital wavetable synthesizer.

BACKGROUND OF THE INVENTION

Typical digital audio synthesizers are a combination of hardware, firmware and software (see, e.g., U.S. Pat. No. 5,668,338), which store sample data for various types of sounds, such as those produced by instruments, voices etc., in a variety of manners (typically chips, programmable read-only memories or PROMs, or firmware). They process the sample data to produce the desired sounds, and "play" the sounds primarily in Musical Instrument Digital Interface (MIDI) and the Audio Wave File formats.

Specifically, the sample data is used to create waveforms, which are then stored as wavetables in hardware or firmware. A sample for a given note is obtained and then digitally manipulated or modified to obtain adjacent notes. Accordingly, it is not standard practice to sample all notes and tones, but rather only some notes or tones are sampled and the adjacent notes or semi-tones are electronically generated. Further, conventional synthesizers are not very portable (e.g., they are difficult to easily transport due to their size). Conventional synthesizers can also be cumbersome or difficult to interface with devices such as personal computers. Consequently, there is a need for a synthesizer that can capture an extensive collection of notes and tones, is portable, and is accessible or easy to interface with many types of devices.

SUMMARY OF THE INVENTION

The present invention is directed to a software implementation of a music synthesizer that may be readily installed and operated on a conventional computer without the need for a music synthesizer soundboard. A conventional soundboard provides the necessary input and output access required by the software system. This advantageously allows portability from one computer to another. In one embodiment, the music synthesizer comprises an input device to sequentially accept musical sounds corresponding to a plurality of single musical notes at semi-tone intervals from a selected musical instrument and to generate measured digital samples thereof. The measured samples contain at least one complete cycle of each of the plurality of single musical notes at the semi-tone intervals. A processor software module analyzes the measured sample data points for each of the plurality of single musical notes at the semi-tone intervals and extracts therefrom one complete cycle of each of the plurality of single musical notes at semi-tone intervals. The processor software module further processes the extracted data to determine the frequency of one complete cycle of each of the plurality of single musical notes at semi-tone intervals and to normalize the extracted data such that a first data sample in the extracted data for the one complete cycle of each of the plurality of single musical notes at semi-tone intervals has an amplitude of zero. A data structure stores the normalized data for the one complete cycle of each of the plurality of single musical notes at semi-tone intervals in association with a data identifier wherein the data structure contains at least one complete cycle of each of the plurality of single musical notes at semi-tone intervals for the selected musical instrument.

In one embodiment, the complete cycle of each of the plurality of single musical notes at semi-tone intervals is characterized by a plurality of measured sample data points. The processor software module determines a starting point of the one complete cycle of each of the plurality of single musical notes at semi-tone intervals by calculating a time shift between first and second measured sample data points of the plurality of measured sample data points where the one complete cycle of each of the plurality of single musical notes at semi-tone intervals begins.

In addition, the software processor can process successive ones of the plurality of measured data sample points of the one complete cycle of each of the plurality of single musical notes at semi-tone intervals to generate values that are calculated by interpolating between measured sample data points to determine a data value at the time shift between the successive measured sample data points. The processor software module further determines a normalized amplitude for each of the determined data points at the time shift between successive measured sample data points by determining the actual range between the greatest positive data value and the greatest negative data value for the measured sample data points and calculating a ratio of a desired range to the actual range. The processor software module adjusts the determined data values at the time shift between the successive measured sample data points by applying the calculator ratio thereto.

In one implementation, the data structure may be implemented with a database software program. In an exemplary embodiment, the database software program may be a conventional software program to allow easy portability between computing platforms.

The data structure may comprise a note specification data structure and a sample value data structure. The note specification data structure may contain a number of data fields to identify the selected instrument, to identify a particular one of the plurality of single musical notes at semi-tone intervals, and to identify the number of sample data values for the one complete cycle of the particular one of the plurality of single musical notes at semi-tone intervals. The sample values data structure contains data fields to identify the selected musical instrument, to identify a particular one of the plurality of single musical notes at semi-tone intervals, and also includes a sample data field containing data values for the one complete cycle of the particular one of the plurality of single musical notes at semi-tone intervals.

In addition to the data processing and storage system to store data samples, the synthesizer may further comprise a rules data structure to store a set of rules associated with the generation of musical notes and a user interface operable by a user to select a sequence of musical notes. A music file generation processor is coupled to the user interface and receives data indicative of the user-selected sequence of musical notes. The generation processor accesses the rules data structure and applies the set of rules to the user-selected sequence of musical notes to thereby generate a musical output file. A soundboard coupled to the synthesizer can play the musical output file.

BRIEF DESCRIPTION OF FIGURES AND DRAWINGS

In the following figures, like reference numerals and reference labels refer to like parts throughout the various views unless otherwise indicated.

FIG. 5 is a listing of numerical sample values for one of the complete cycles of the waveshape diagram shown in FIG. 4.

FIG. 12 is a "Note Specification" table dataview snapshot.

FIG. 13 is a "Sample Values" table dataview snapshot.

FIG. 27 is a list of algorithms used in an embodiment of the CSDWS.

DETAILED DESCRIPTION

INTRODUCTION AND OVERVIEW

Figure 1:
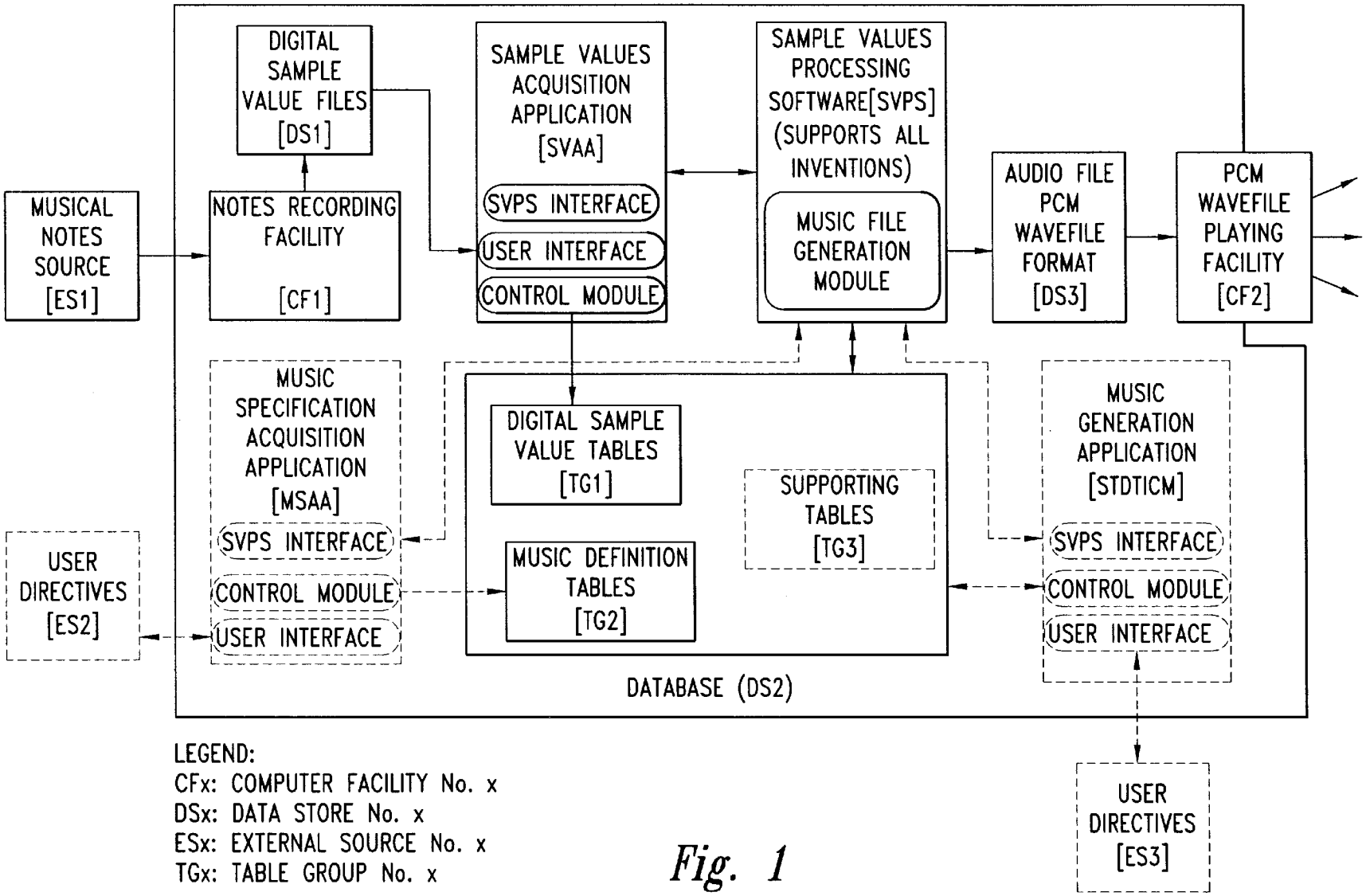
FIG. 1 is a functional block diagram of a customizable software-based digital wavetable synthesizer (CSDWS) system according to one embodiment of the invention.

A customizable, software-based digital wavetable synthesizer (CSDWS) according to one embodiment of the invention comprises (1) a set of software processes that accomplish the gathering and organization of basic sample data required by digital audio synthesizers, and storage of such data in a modular fashion in a general-purpose database and (2) a set of software processes that operate on the such data in order to generate digital audio files formats that can be "played" by an appropriate device (such as a computer equipped with a sound card).

As will be described below, CSDWS may be completely data-driven and software based, according to some embodiments of the invention. Basic data required for digital music specification is stored as numerical data in a general-purpose or dedicated database. The algorithms for using this data and generating music files are entirely software-based. These features make the CSDWS open, customizable, and extensible. The use of small individual sample data units makes the size of the data files quite manageable and processing very efficient.

In this regard, one embodiment of the CSDWS comprises:

(1) A computer or other device capable of (a) supporting the implementation of a database management system (DBMS), (b) storing the data required for the operation of the CSDWS in a database, and (c) executing software module(s) that carry out the computational processes that need to be carried out on the data for the operation of the CSDWS; and (2) A computer or other device capable of "playing" digital music files, [e.g., in the pulse code modulation wave (PCM Wave) format (e.g., .wav extension for Windows™-compatible computers)].

The computers and/or devices specified in (1) and (2) above may comprise a single machine equipped with appropriate software (e.g., a relational DBMS) and hardware (e.g., a "sound card").

The CSDWS captures and stores data in a specific manner that isolates the data for one or more cycles of the applicable digitized sound in order to generate notes of a series of frequencies, each a semi-tone apart, for each individual type of sound. This practically eliminates the need for algorithms for "pitch bend" or restricts it to a span of at most a quartertone lower or higher frequency, thus helping to preserve the tonality of the sampled sound. The software algorithms manipulate sample values to control volume, loop through the desired number of cycles to generate the required duration of the tone, and produce the desired kinds of transitions between notes of different pitches or frequencies.

As will be described in greater detail below, various software algorithms can be used by embodiments of the present invention. These algorithms include, but are not limited to, algorithms to produce desired special musical effects, grace notes, quarter tones, fully overlapped transitions between notes, glide from one note to another note, oscillatory patterns between two notes, drone accompaniment, and other such algorithms.

The CSDWS is customizable, as the user can capture new sample data and have it integrated and used in a consistent manner along with the existing sample data and existing processes, and implement new algorithms for producing the desired musical sounds and effects.

An embodiment of the CSDWS is completely software-based. The sample data is captured and stored as digital or numeric data in a general-purpose database. The data can be directly accessed, added to and/or updated by the user for customization purposes (e.g., in order to obtain desired types of sounds that are not available in a given state of the CSDWS). This is in sharp contrast with most PC-based synthesizer/sound cards, which program selected musical notes on integrated circuit memory chips (i.e., firmware) that is customized for a particular soundboard. Such firmware-based synthesizers lack the desired portability between computing platforms whereas the software based synthesizer of the present invention may be readily loaded and executed on any computing platform having the components described above. In addition to portability, the storage of sample notes for each semi-tone by the CSDWS allows faithful reproduction of musical notes. In contrast, the firmware based synthesizers only store selected musical notes. Intermediate musical notes must be mathematically derived, which may result in inaccurate reproduction of musical notes.

Having all the data required for the generation of music and other sounds stored in a general-purpose database permits the applications using the stored sounds to also use the same database to store their data to implement open, extensible, integrated and efficient applications.

An embodiment of the CSDWS may be implemented as a working program on a general-purpose computing device (such as a typical IBM PC-compatible "multi-media" computer). Such a device can have the following components: central processing unit (CPU), random access memory (RAM), a hard drive or other data storage mechanism (magnetic, optical or otherwise), a keyboard or other input device, a display monitor, a facility such as a sound card that can accept the input of sound via a microphone or other input device for recording the sound in the form of sound files (e.g., in the PCM Wave format) and that can "play" recorded sound files (e.g., in the PCM Wave format) via speakers or other output device, built into the body of the computing device or attached and connected thereto. Further, a data storage facility (e.g., a relational DBMS) can be installed on the device to facilitate storage and retrieval of data in a systematic manner. According to one CSDWS embodiment, the data storage system comprises a relational DBMS, as is reflected in the figures and the description provided herein. While a conventional DBMS is used for convenience in the storage and retrieval of data samples, the invention is not limited to using a relational DBMS. Those skilled in the art will recognize that any data structure may be used for the storage and retrieval of data samples. Accordingly, the present invention is not limited by the specific form of data storage/retrieval structure.

Embodiments of the CSDWS may be utilized with other methods and systems that provide a user with a facility to synthesize music of any desired kind on a general-purpose computer, equipped with a commonly available audio processing facility such as a sound card, with no requirement for additional special purpose or dedicated hardware or firmware components. Further, an embodiment of the invention permits the implementation of open, customizable, and extensible embodiments. The following advantages are provided:

(1) The user can add new types of sampled sounds that are not available in a particular embodiment of the invention, and integrate them seamlessly with the existing embodiment.

(2) The user can define any kind of music in which the user is interested, and add in all the required data including the definition of and the associated generation algorithms for any special types of sounds required for the music and the desired musical notations, and integrate them seamlessly with the data existing in the embodiment.

(3) The user can provide audio demonstration of the music stored in it, using the capabilities provided, or any new capabilities (for example, for different types of sounds that are not available via the existing capabilities) which can be added by the user.

The CSDWS may be utilized with a Software Tool for Acquisition of Computer-Interpretable Specification for Indian Classical Music ("STACISICM"). An example of an STACISICM is described in the provisional patent application identified above and hereby incorporated by reference. The CSDWS may also be utilized with a Software Tool for Demonstrating and Teaching Indian Classical Music ("STDTICM"). An example of an STDTICM is also described in the provisional patent application identified above and hereby incorporated by reference. Examples of these software tools are provided below. However, those familiar with Indian classical music will recognize that other techniques may be used to acquire and demonstrate Indian classical music. In addition, other forms of music besides Indian classical music may be implemented by the CSDWS.

FIG. 1 is a block diagram of an embodiment of a CSDWS showing major components and illustrating their interrelationships. CSDWS specifically deals with the software modules that acquire and process musical sounds to create a software-based database of musical notes, the application of software-based musical rules to a user-selected sequence of stored musical notes and the software production of musical sounds. The CSDWS acts as the enabler for other objectives, such as STACSICM and STDTICM. Therefore, only the components that are relevant for an embodiment of the CSDWS are identified by a solid border in FIG. 1. The other components are shown with a dashed border and identified using smaller size font. They are described in the STACSICM and STDTICM provisional applications previously incorporated by reference. The CSDWS may be readily used to synthesize any form of music. The specific implementation for use with Indian classical music requires the application of certain rules for the formation of tone sequences typically used in Indian classical music. The set of rules associated with Indian classical music is well known in the art by those familiar with Indian classical music. For example, a "glide" is a smooth transition from one note to another over a predetermined time period. Some examples of rules are provided below. However, those skilled in the art will recognize that other rules directly applicable to Indian classical music may also be stored as part of the music specification acquisition application (MSAA) illustrated in FIG. 1. Furthermore, those skilled in the art will recognize that other forms of music, such as European classical music or jazz, each have their own set of associated rules. These rules are stored in the MSAA. Those familiar with each genre of music are familiar with the associated rules. For the sake of brevity, the various sets of rules need not be described herein. However, it is clear that the present invention is not limited only to the set of rules associated with Indian classical music, but is applicable to any form of musical expression.

1.0 Description of the Relevant Components in the Block Diagram of FIG. 1 (in alphabetical order)

The following description of the functional blocks illustrated in FIG. 1 is provided below. Additional details of the blocks used to implement the CSDWS are provided below. Components that are well known, such as a computer soundboard, will only be described briefly since the operation of those components is well within the knowledge of those having ordinary skill in the art.

1.0.1 Component CF1: The Notes Recording Facility.

This component is one of the facilities available in the computer. One form is a sound card that is capable of recording the sounds generated by the component ES1, which is described below. This may include a microphone to record a musical instrument.

1.0.2 Component CF2: The Wavefile Playing Facility.

This component is one of the facilities available in the computer. One form is a sound card that is capable of "playing" audio files (e.g., PCM Wavefile format files). Physically, it can be the same component as CF1. A conventional sound card typically has both input (i.e., recording) and output (i.e., playback) capabilities required by components CF1 and CF2.

1.0.3 Component DS1: Digital Sample Value Files.

These files are created by the facility CF1 and comprise digital audio files that record the sounds generated by the component ES1. These files are used during the creation of the Samples data in CSDWS.

1.0.4 Component DS2: Data Storage Area.

DS2 is a main data storage area, (e.g., a relational database). All the data required to support achieving all the objectives stated above in the Introduction and Overview are stored in DS2.

1.0.5 Component DS3: The Audio Files.

These are the audio files produced by a Music File Generation module of a component SVPS, which is described below.

1.0.6 Component ES1: The musical note source.

ES1 is an external source that can produce the desired musical note sounds whose samples are to be captured. Any source that can produce the desired musical sounds (e.g., a keyboard synthesizer already containing samples of various sounds or a person playing a musical instrument) is adequate. A microphone can also be used to record musical sounds directly from an instrument (e.g., a flute or clarinet).

1.0.7 Component SVAA: The "Sample Values Acquisition Application".

This component contains the set of software modules that generate the data for the synthesizer by scanning the files in component DS1 and creating the samples in the required format and storing them in the database tables in the component TG1. The operation of the SVAA component is described in detail below.

1.0.8 Component SVPS: The "Sample Values Processing Software".

This component contains all the software modules that process and transform the samples stored in component TG1 into digital music files as required.

1.0.9 Component TG1: The "Digital Sample Value Tables".

The data in these tables forms the main body of the basic data in CSDWS that is required by applications built to use the CSDWS. These tables are populated by the "Control module" of the SVAA component from the raw data contained in the files of component DS1.

1.1 The Basic Principles in Building a "Synthesizer"

A synthesizer, as the name implies, synthesizes or builds a target entity from its components. In order to do so, it is essential to determine what the fundamental components or building blocks of the target entity are. Such building blocks may be basic atomic or primitive components which cannot be further subdivided, or may be sub-entities which have been built from still more basic components.

However, it is almost always advisable to go down to the lowest level of decomposition in analyzing an entity to be synthesized in order to determine its building blocks or primitives at the atomic level and specify the synthesis process in terms of such atomic components. This allows for complete control and flexibility in defining the synthesis process and, as a result, the synthesized product is more likely to fully satisfy its requirements.

The present invention may synthesize music in the computerized digital form without the need for specialized hardware or firmware.

Typically, computerized music is played over one or more channels where each channel is "playing", concurrently with other channels, an independent piece of music that is not procedurally related to what is being played or not played on other channels. That is, the computer processing of data for one channel is independent of the computer processing for data for another channel. Therefore, from our viewpoint we can concentrate on and analyze the music that is being played on one channel. If we can synthesize that then we can address any number of channels that may be concurrently playing.

When music is played over a channel, at any given instant, the channel is playing sound of a certain type at a certain pitch, and at a certain volume. Further, even though we are talking of an instant, the sound is really being played over a discrete interval of time, however short or long the interval might be. When the sound changes any of its characteristics (e.g., pitch, or volume) we have a new sound with different characteristics than the original, again playing over a discrete interval. If the change is in a stepwise fashion, the end of the first sound is concurrent with the beginning of the next sound. However, even if the change is in a gradual fashion and takes place over long enough time, the sound still has a definite loudness and a definite pitch at any one instant within that period. We can consider that to be a step of very small time duration, say $1/100^{th}$ of a second. Thus, we can substitute what is perceived as a continuous change by the human ear, by a sequence of steps of sufficiently short duration each having a definite and constant loudness and pitch for the sound.

Thus, the "atomic" or primitive unit that we are looking for appears to be a sound of a certain type, playing at a certain constant volume or loudness, at a certain constant frequency or pitch, and over a certain duration of time. If the synthesizer has the capability of producing such sounds, then they can be appropriately sequenced to synthesize continuous musical sounds. These characteristics can be represented by a digitized representation of sound.

Figure 2:
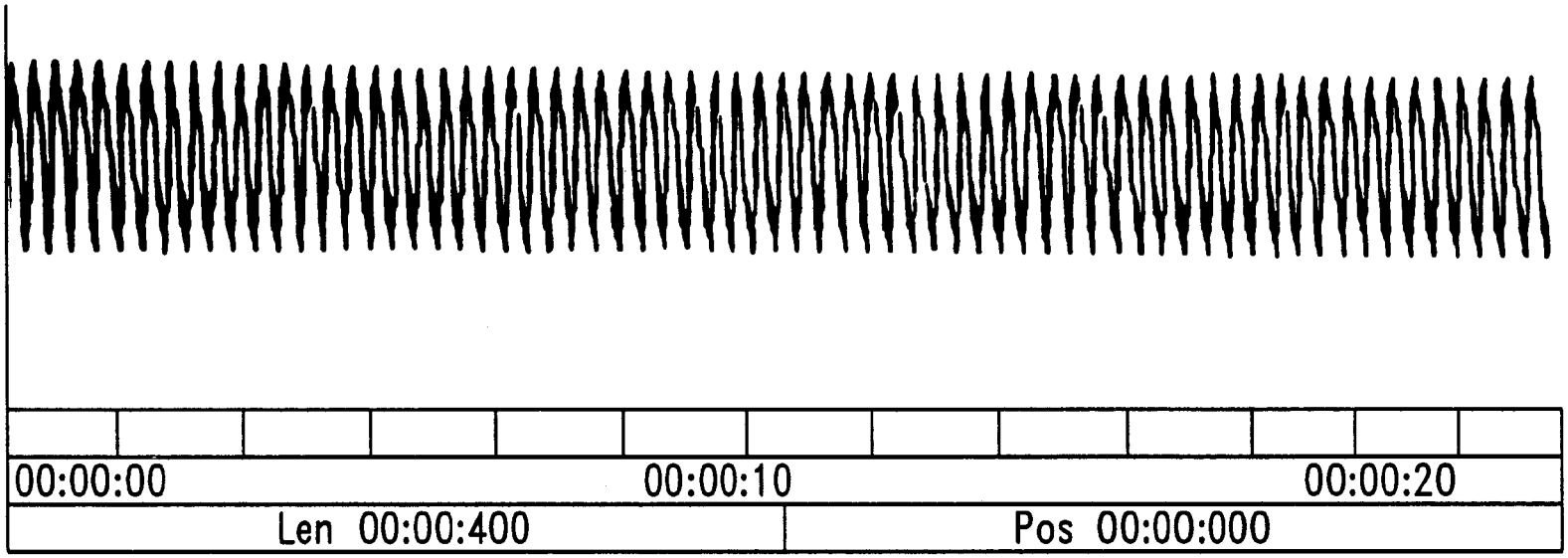
FIG. 2 is a waveshape diagram for a note (C#) for a short duration of a sampled sound produced by a clarinet.

For example, FIG. 2 shows a graphical representation of the data in an audio wave file, and represents digital data associated with an audio segment of about 0.23 seconds duration for a single note of sampled clarinet sound at a constant pitch played on a synthesizer keyboard and saved as a wavefile in the PCM Wave format. This is a partial segment of the recording of the note C#, using the voice of a clarinet on a Kurzweil K2000 synthesizer. The recording was made with a 44.1 kHz sample rate (i.e., 44100 samples per second). The nominal frequency of the note is about 275 cycles per second (cps). That implies that there are about 44100/275 or 160.36 samples per cycle. The segment in the figure has duration of about 0.23 seconds as shown on the horizontal axis, and therefore contains about 64 cycles. The shape of the cycles appears to be fairly uniform.

Figure 3:
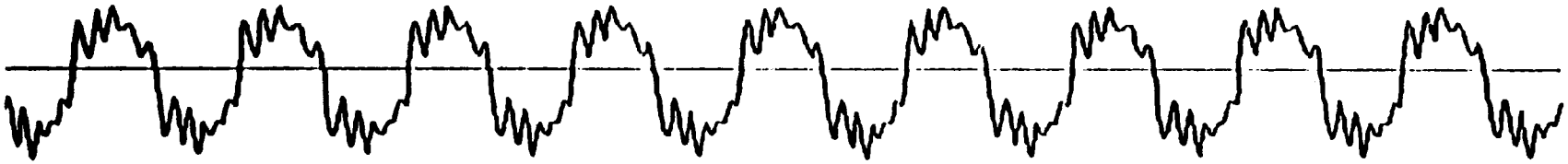
FIG. 3 is a waveshape diagram of the same note shown in FIG. 2 but for a 0.025 second duration.

FIG. 3 is a zoomed-in view of a segment of the waveform shown in FIG. 2 and spans about 0.03 seconds covering about 8 cycles of the waveform (e.g., the duration is about $1/10^{th}$ of that in FIG. 2 (about 0.025 seconds). It appears that the shape of any cycle is quite similar to that of every other cycle.

Figure 4:
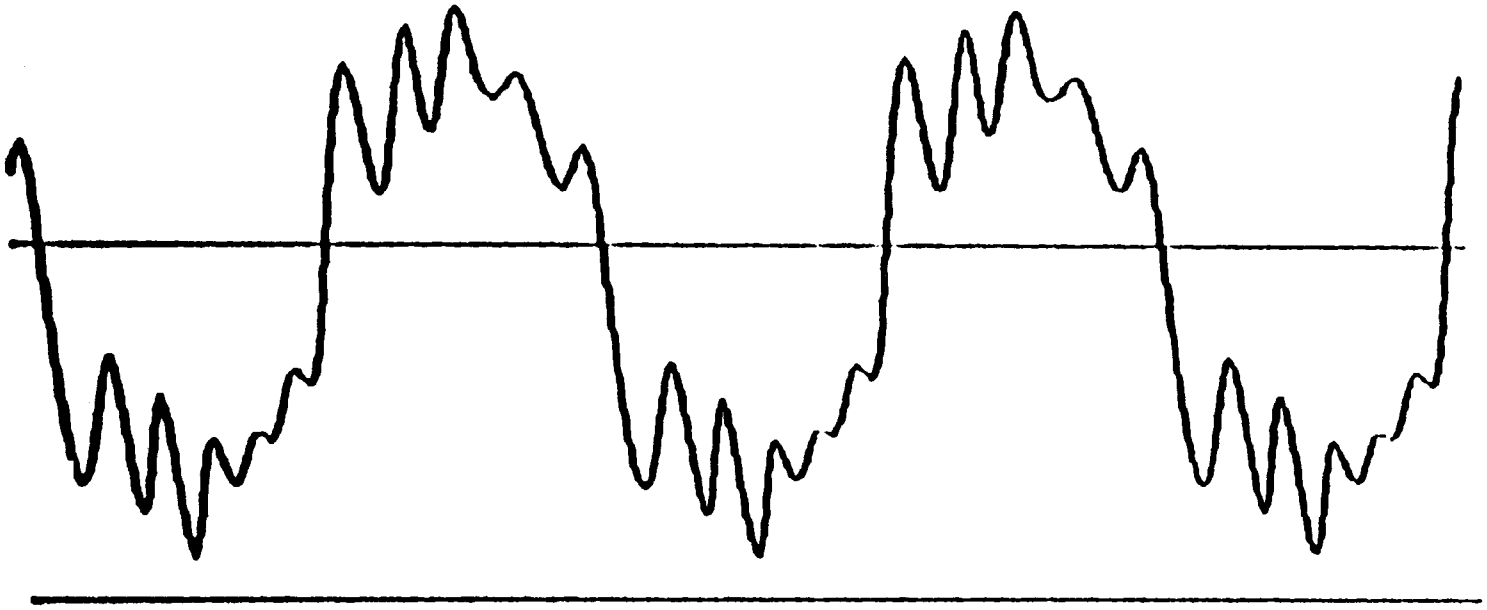
FIG. 4 is a waveshape diagram of the same note shown in FIGS. 2 and 3 but for approximately two cycles.

FIG. 4 is a further close up of the waveform of FIG. 2 showing above two cycles and having a duration of about 0.005 seconds, and again it seems to confirm the conjecture that each cycle is very similar in shape to other cycles.

FIG. 5 is a printout of the actual data (e.g., digital values in the form of integer numbers) for one complete cycle of the waveform shown in FIGS. 2, 3, and 4 with different magnifications or time lengths, and as estimated earlier, the cycle consists of about 161 samples. The waveform diagrams of FIGS. 2, 3, and 4 are just the plots of these values along the Y or vertical axis, with the time plotted along the X or the horizontal axis. Please note that the negative values are plotted above the X axis line while the positive values are plotted below that line. It should be noted that the table of FIG. 5 actually contains 162 sample points because the beginning of the waveform (i.e., the start of the complete cycle) actually falls between sample points. After the normalization process, which will be described in detail below, the beginning of the waveform will coincide with the first sample point with the resultant complete cycle of the waveform containing 161 samples.

Figure 6:
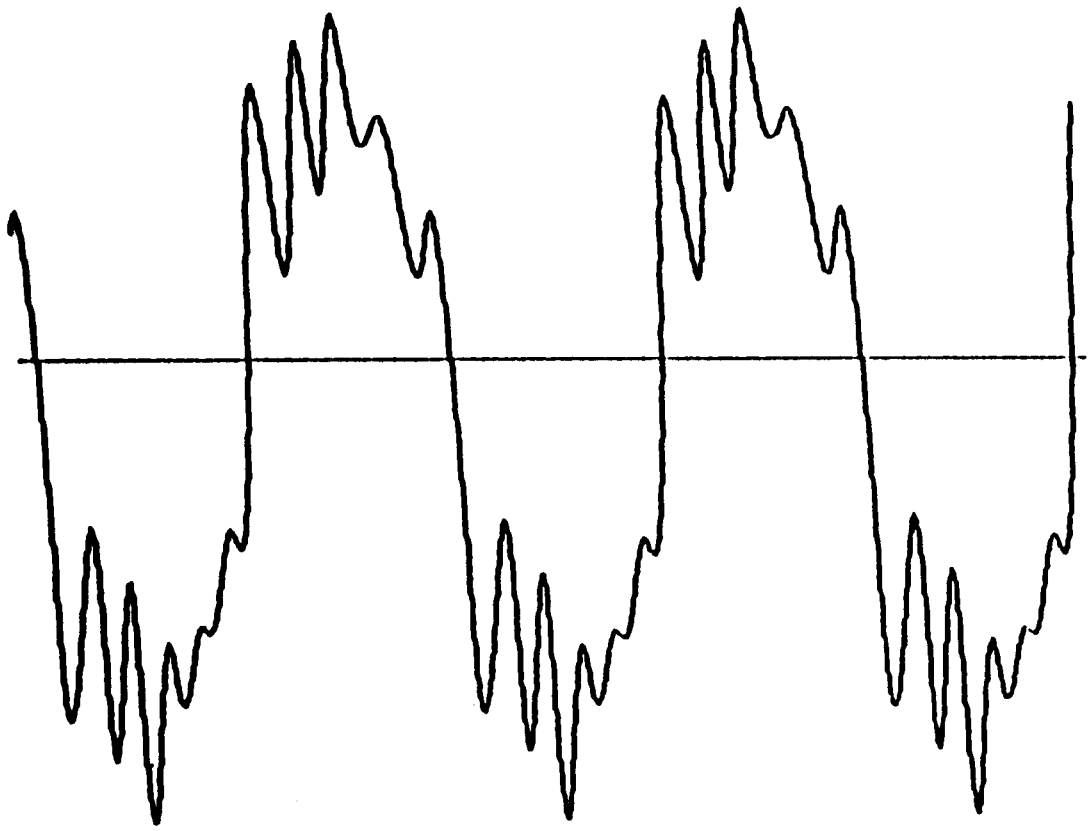
FIG. 6 is a waveshape diagram of approximately two cycles for note C# at a greater amplitude than the waveshape diagram of FIG. 4 indicating a greater volume.

FIG. 6 is the waveform of approximately two cycles for note C# (such as that shown in FIGS. 2, 3, and 4) when the same note is played at a louder volume. It is seen that the basic shape of the waveform in FIGS. 4 and 6 is identical while the ordinates of the plotted values are proportionately larger in FIG. 6 where the volume was louder. This shows (and the scan of the actual values proves) that the loudness of the sound is represented by an appropriate constant factor applied to the data values of the wavefile.

Figure 7:
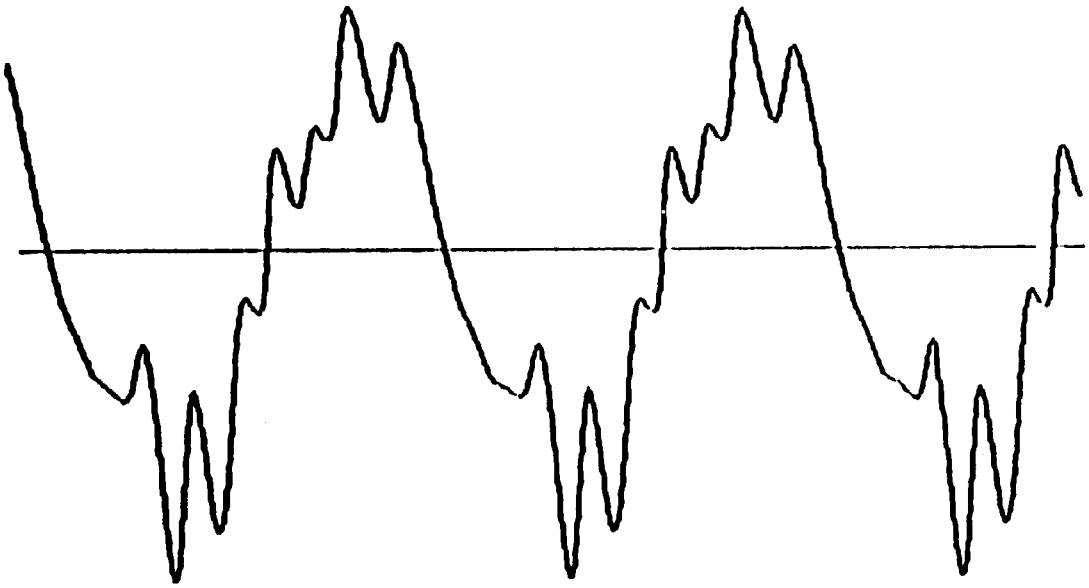
FIG. 7 is a waveshape diagram of approximately two cycles for note D.
Figure 8:
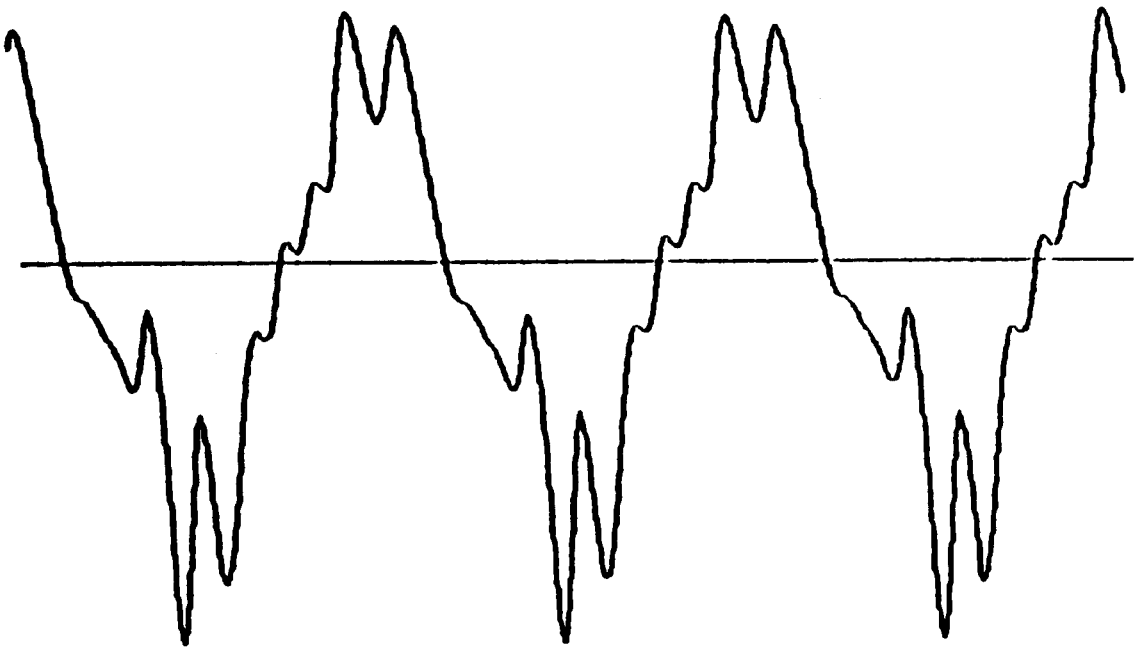
FIG. 8 is a waveshape diagram of approximately two cycles for note D#.

All the waveforms shown in FIGS. 2 through 6 are for the same note, (i.e., note C#), played with the sampled clarinet sound from a Kurzweil K2000 keyboard synthesizer. FIG. 7 shows the waveform for two cycles from the same keyboard and instrument of the next note (D) which is just a semi-tone higher than the note C. Note D has a nominal frequency of 294 cps, which leads to 151.2 samples per cycle at the recording rate of 44,100 samples per second. It will be seen that not only the sample count is different, but the shape of the waveform is also significantly different as can be readily seen by comparing the waveshape diagrams of FIGS. 6 and 7. This observation is further confirmed by the waveshape diagram in FIG. 8, which depicts the plot of approximately two cycles for the next note D#, with the nominal frequency of about 308 cps which amounts to about 143.5 samples per cycle. As can be seen in FIGS. 6–8, the waveshape is substantially different for each semi-tone from the clarinet.

Thus, the following four conclusions can be drawn.

(1) The digitized data captures the waveform pattern of the sound that it represents.

(2) The frequency of vibration (i.e., cycles per second) of a note at a particular pitch is directly represented by the number of cycles per second in the digitized data, when plotted as a graph.

(3) The shape of each cycle in the plot of the digitized data, for a certain note played at constant volume over a certain time period, is extremely close if not exactly identical to all other cycles in that plot.

(4) In the plot of the digitized data for the same type of sound (i.e., the same voice or instrument) the shapes of individual cycles for different notes with different frequencies are significantly different from each other even for notes that are fairly close in pitch to one another.

While different notes from the same instrument have waveshapes that differ significantly, different instruments producing the same note also have dissimilar waveshapes, which account for the unique sounds of each musical instrument. For example, FIG. 9 shows the waveshape for approximately two cycles of the sampled sound of flute from the same keyboard synthesizer for the note C#, and FIG. 10 shows similar waveshape of the sampled sound for a violin.

Figure 9:
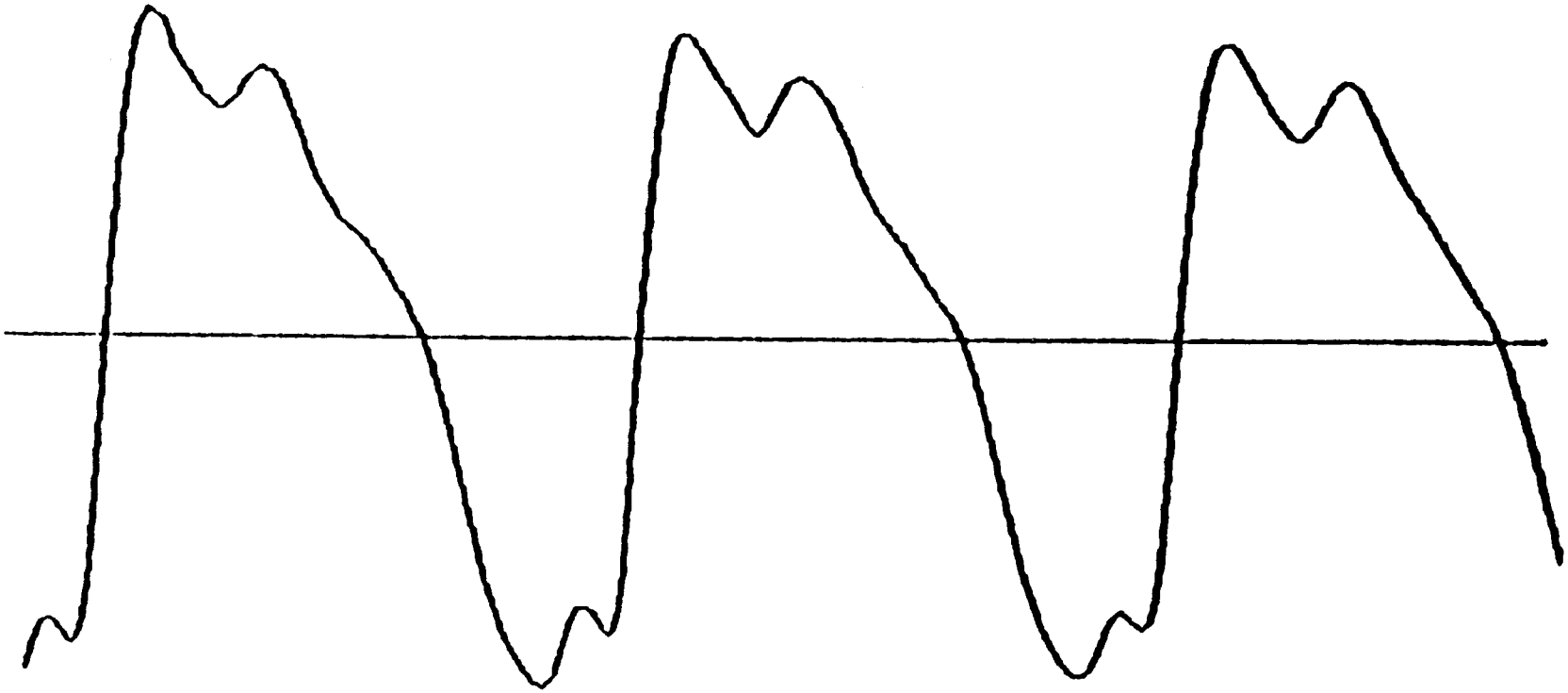
FIG. 9 is a waveshape diagram for a note (C#) of sampled sound of a flute showing approximately two cycles.
Figure 10:
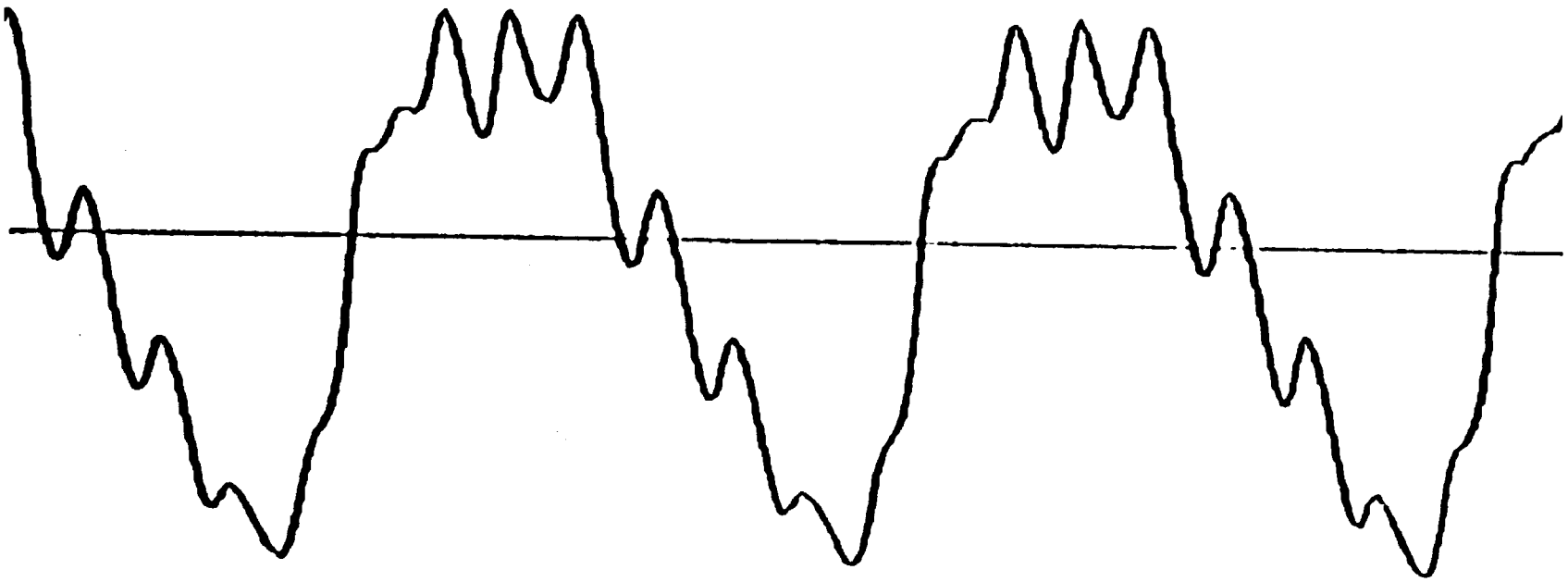
FIG. 10 is a waveshape diagram for a note (C#) of sampled sound of a violin showing approximately two cycles.

Comparing FIGS. 4, 9 and 10 which are the plots of the waveforms for the same note with the same frequency for instruments clarinet, flute, and violin, it is readily seen that the shapes are quite different from each other. This leads us to the fifth conclusion, as follows.

(5) In the plot of digitized data for different types of sounds (different voices or different instruments) the shape of each cycle is quite different for each type even if the notes have the same frequency or pitch, and volume.

These five conclusions are sufficient for us to determine the primitive or the atomic unit that we are seeking for building a synthesizer. That atomic unit is the digital data representing one cycle for each discrete note and for each discrete voice type that the synthesizer is going to play. If we use the model of a keyboard where the discrete notes are each a semi-tone apart, then this leads to 12 notes per octave. Therefore, if we decide to design our synthesizer to provide "N" number of octaves each for "V" number of voices, then the total number of cycles to be stored in the synthesizer will be "12 times N times V". Additionally, we will in one embodiment provide a facility for generating a variety of musical sounds from the data stored in the synthesizer. Therefore, in order to construct a functional synthesizer, we should devise procedures and algorithms to make that possible. One benefit of this approach is that if we have correctly identified the atomic or primitive units in the digital representation of music, we ought to be able to build or synthesize any kind of musical sound using them.

A key aspect of the invention is, therefore, the ability to be able to capture the atomic or primitive units of music in digital form as identified above, and the ability to synthesize the desired music out of them.

1.2 An Illustrated Embodiment of the Invention

This section will completely describe one embodiment of the approach described above for capturing digital musical samples of the desired set of notes having different frequencies and different sound types. The embodiment also provides a means for deriving and storing in a database any units of music, down to the most primitive (i.e., the definition of and the samples for complete single cycles) from such samples. It will further describe an embodiment for creating wavefiles in the PCM Wavefile format for the sounds of musical notes of a single pitch as well as a series of notes with different pitches, having the desired loudness and for the desired length of time. Other embodiments of this approach can create any other specific types of musical effect desired.

1.2.1 The design of tables for storing the samples data

In creating a facility for storing data for any kind of environment, it is essential to create an information model of the environment. Properly built information models are essential for obtaining a well-designed database table structure that eliminates unnecessary duplication and data inconsistencies. Such a table structure leads to ease of maintenance and facilitates trouble-free extensions of the environment to be addressed.

Figure 11:
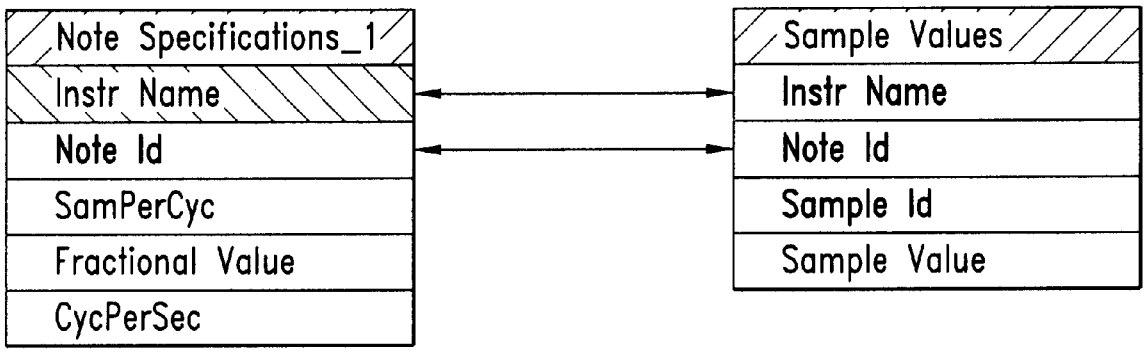
FIG. 11 are tables designed to store sample values.

Such an approach was adopted for the illustrated embodiment of this invention, and a model using the Object Role Modeling (ORM) methodology was created for the environment of music data samples. This model led to the definition of the two tables, "Note Specifications", and "Sample Values", whose schema is shown in FIG. 11, and they are described in sections 1.2.1.1 and 1.2.1.2. FIG. 11 shows the definition (schema) of two tables in a relational database designed to store musical note specifications and the associated sample values for one cycle of each such note in an embodiment of the CSDWS. The lines connecting the two tables indicate how they relate to each other via certain common items stored in both tables.

Such an approach can be followed for extensions of this facility to include any other kind of data.

1.2.1.1 Table "Note Specifications"

Column "Instr Name"

Data in this column is used to identify the name of the voice, instrument or other sound for which sample values are captured. The convention and data format used to identify the sound is user-definable.

Column "Note Id"

Data in this column is used to identify the "reference note", i.e., the chosen sound with a specific pitch or frequency value. The convention and data format used to identify the note name is user-definable.

Column "SamPerCyc"

Data in this column is used to document the integer part of the value of samples per cycle for the reference note.

Column "Fractional Value"

Data in this column is used to document the fractional part of the value of samples per cycle for the reference note. Due to the manner in which Fractional Values are used by the code, a non-zero Fractional Value must be present. Therefore, if the samples per cycle value is an integer number (say 161.0) without any fractional component, the Fractional Value is set to 1, and the integer part is reduced by 1 (i.e. 160 in this case). The sum of the two then gives the true value (i.e. 161).

Column "CycPerSec"

Data in this column gives the frequency value or cycles per second for the reference note.

The sum of the values in columns "SamPerCyc" and "Fractional Value" for a given row of the table gives the complete samples per cycle value for the reference note identified in that row of the table.

In an embodiment of the invention, the integer portion of the samples per cycle and the fractional value of the samples per cycle are separately stored for convenience as these two numbers get used independently in different computations. The value of the integer portion directly gives the actual number of samples stored for the reference note. The fractional value is used in Algorithm 1.1 as will be described in greater detail in section 1.2.4.

FIG. 12 shows a partial snapshot of the data view of the table "Note Specifications" table according to one embodiment of the invention. The values in columns "Instr Name" and "Note Id" together form the composite primary key for the rows in the table. This means that there can be only one row containing data about a specific sound or instrument type and a specific note for that sound or instrument. The other three columns in that row define the relevant data for that sound or instrument type and note combination.

1.2.1.2 Table "Sample Values"

Column "Instr Name"

Data in this column is used to identify the instrument or sound type of the associated sample values. The convention and data format used to identify the instrument name is user-definable.

Column "Note Id"

Data in this column is used to identify the "reference note" (i.e., the chosen sound with a specific pitch or frequency value). The convention and data format used to identify the note name is user-definable.

Column "Sample Id"

Data in this column is used to uniquely identify the sample number from amongst the total number of samples (value in column "SamPerCyc" in table "Note Specifications" for the corresponding note). The samples are identified in sequentially increasing numbers, starting from number 1 to number "SamPerCyc". For example, the data values of FIG. 5 would be identified as samples 1–161, respectively.

Column "Sample Value"

Data in this column contains the numeric integer value of the digital sample (such as that shown in FIG. 5) that corresponds to the "Sample Id" th sample for the reference note.

FIG. 13 shows a partial snapshot of the data view of the table "Sample Values" according to one embodiment of the invention. The values in columns "Instr Name", "Note Id", and "Sample Id" together form the composite primary key for the rows in the table. This means that there can be only one row containing data about a specific sound or instrument type, a specific note for that sound or instrument, and a specific sample number for that note. The fourth column in that row contains the sample value.

The Note Specification table and the Sample Values table are sufficient to completely store the sample data for one or more complete cycle for all the desired notes for all the desired sound types. Those skilled in the art will recognize that other forms of data structures may be used satisfactorily with the present invention.

1.2.2 Process of Obtaining the Desired Samples and Creating Digital Sample Value Files [DS1]

Figure 14:
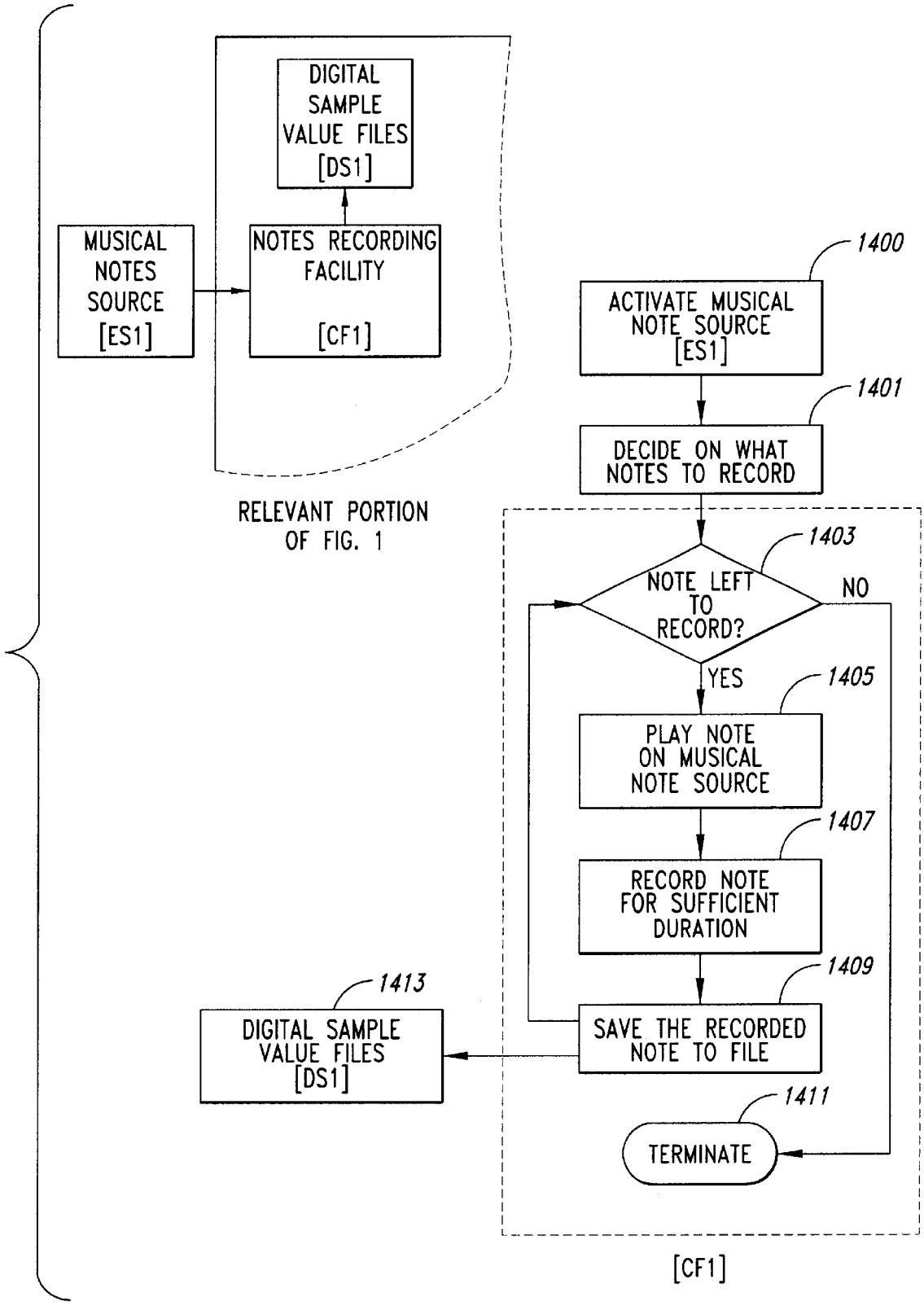
FIG. 14 is a flow chart illustrating an embodiment of a process of acquiring and storing sample data in a database.

FIG. 14 is a flow chart providing details of the process of acquiring and storing the sample data in the database of the CSDWS. This process is represented in FIG. 1 by the component CF1 (i.e., the Notes Recording Facility). The related portion of FIG. 1 associated with the acquisition and storage of sample data is also included in FIG. 14 for ease in understanding the process.

The process involves activating the desired musical note source ES1, playing and recording the desired notes using the microphone or other similar facility in CF1, and saving the digital sound recording files of sufficient duration for each of the desired notes. This process can be repeated for each desired sound source.

The user activates a musical note source, such as ES1 (step 1400). The user decides what notes to record (step 1401).

If the user still has notes left to record (step 1403), then the user plays a note on the musical note source, such as ES1 (step 1405). The user records the note for a sufficient duration (step 1407). A sufficient duration constitutes a duration sufficiently long to record an exemplary cycle for the note. The user next saves the recorded note in a file (step 1409). The notes may be saved in a digital sample file, such as DS1 (step 1413).

The process returns to step 1403 to determine if other notes are left to record. When the user has no more notes remaining to be recorded (step 1403), then the process of obtaining the desired samples and creating digital sample value files terminates (step 1411).

1.2.3 Process of Using the Data in Files [DS1] and Extracting and Loading the Normalized Single Cycle Digital Data for the Desired Notes and Sound Sources in Tables [TG1]

Figure 15:
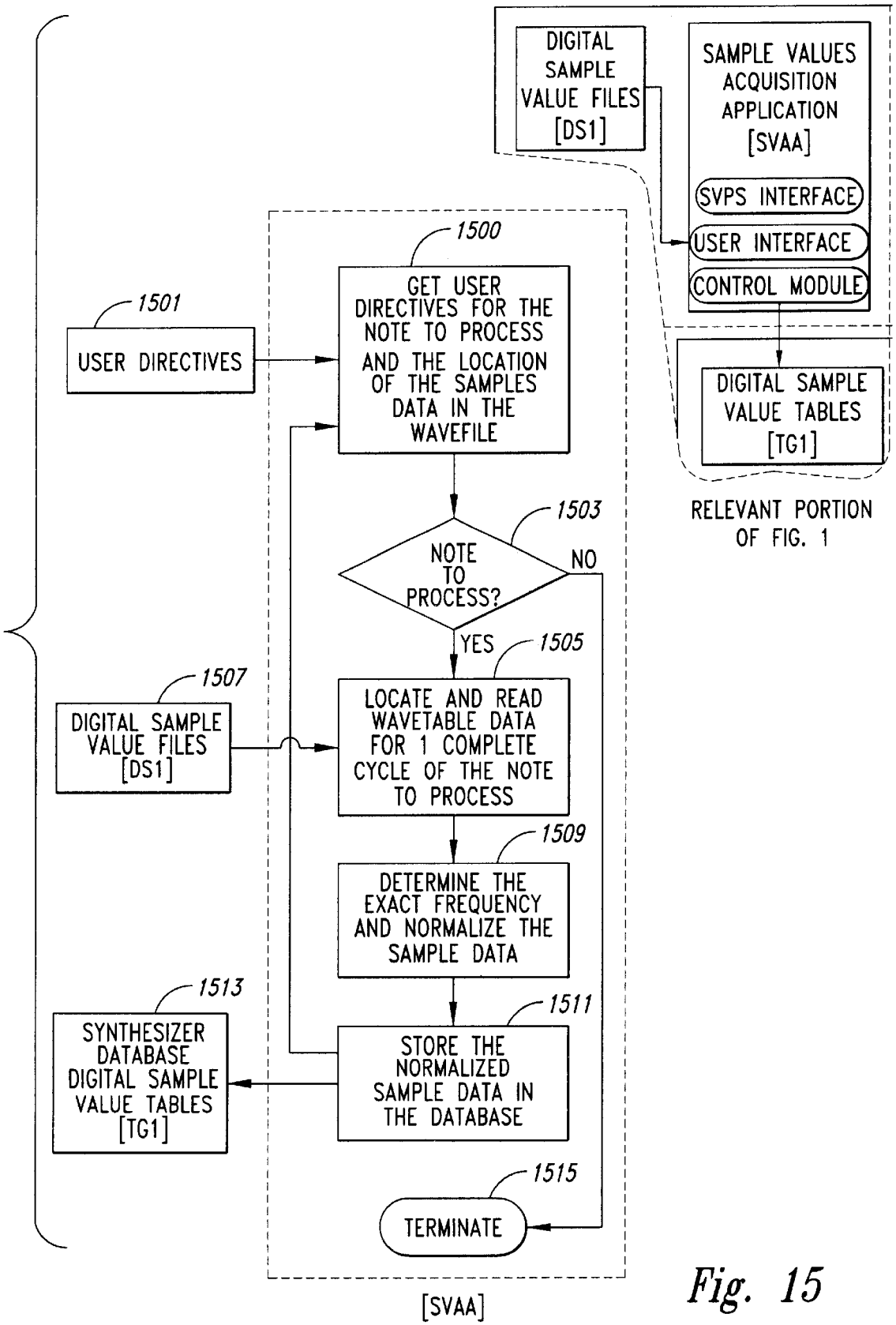
FIG. 15 is a flow chart illustrating an embodiment of a process of recording and saving the files of digital sound samples of notes.

FIG. 15 is a flowchart depicting the process of recording and saving the files of digital sound samples of notes. Digital sample value files [DS1] provide the data input for this process. This process is represented by the component SVAA in FIG. 1. The related portion of FIG. 1 associated with the sample values acquisition process also included in FIG. 15 for ease in understanding the process. The process comprises reading the data for the desired note, locating and isolating the data for one cycle of the note, normalizing the isolated data (see section 1.2.4) and storing the normalized data in the database tables [TG1]. The process operates as follows.

The user decides what note to process and the location in the file from which to extract the sample data, or whether the notes processing is completed, and inputs this information (step 1501) to the program (step 1500), which processes the user directives for the note process and the location of the sample data within the wavefile.

If there is a note to be processed (step 1503), the program locates the sample values data for that note in a source such as DS1 (step 1507) created previously and made available to the program, and extracts the sample values data for one complete cycle (step 1505). A number of known techniques may be used to determine the starting and ending points for one complete cycle. For example, step 1505 may use the known nominal frequency of the musical note and the locations in the data waveform where the data values change sign from plus to minus or minus to plus to determine the number of samples to read to ensure that data for one complete cycle is available. Other known techniques may also be used. Those techniques are within the scope of knowledge of one of ordinary skill in the art and need not be described herein.

The program then determines the exact value of the frequency of the note and normalizes the samples data (step 1509) as per the procedure and Algorithm 1.1 described in section 1.2.4. The exact frequency may be determined by interpolating the point of zero crossing. The process of normalization involves adjusting the data values so that the first data value is always zero, and ensuring that the numeric range between the largest positive and negative values is the same for all notes.

The normalized sample values are then stored (step 1511) in appropriate database tables such as TG1 (step 1513), and the program looks for the user directives (step 1501) for the next note to be processed (step 1500).

If there is another note to process (step 1503), the above process is repeated for that note. If there are no more notes to process (step 1503) the process of acquiring and storing note samples in the database terminates (step 1515).

The user can hear the sound of the note by using the extracted sample, and generating a music file containing the sound of a single note for the desired length of time by using the procedures outlined in section 1.3.2. If the sound is unsatisfactory, the user can repeat the extraction process by directing the program to extract the sample values from another location (step 1500) of the sample wavefile in the source such as DS1, and the entire process can be repeated until a satisfactory sample is obtained.

1.2.4 Process of Normalizing Single Cycle Digital Data Samples before Storing them in Database Tables [TG1]: Algorithm 1.1

Figure 16:
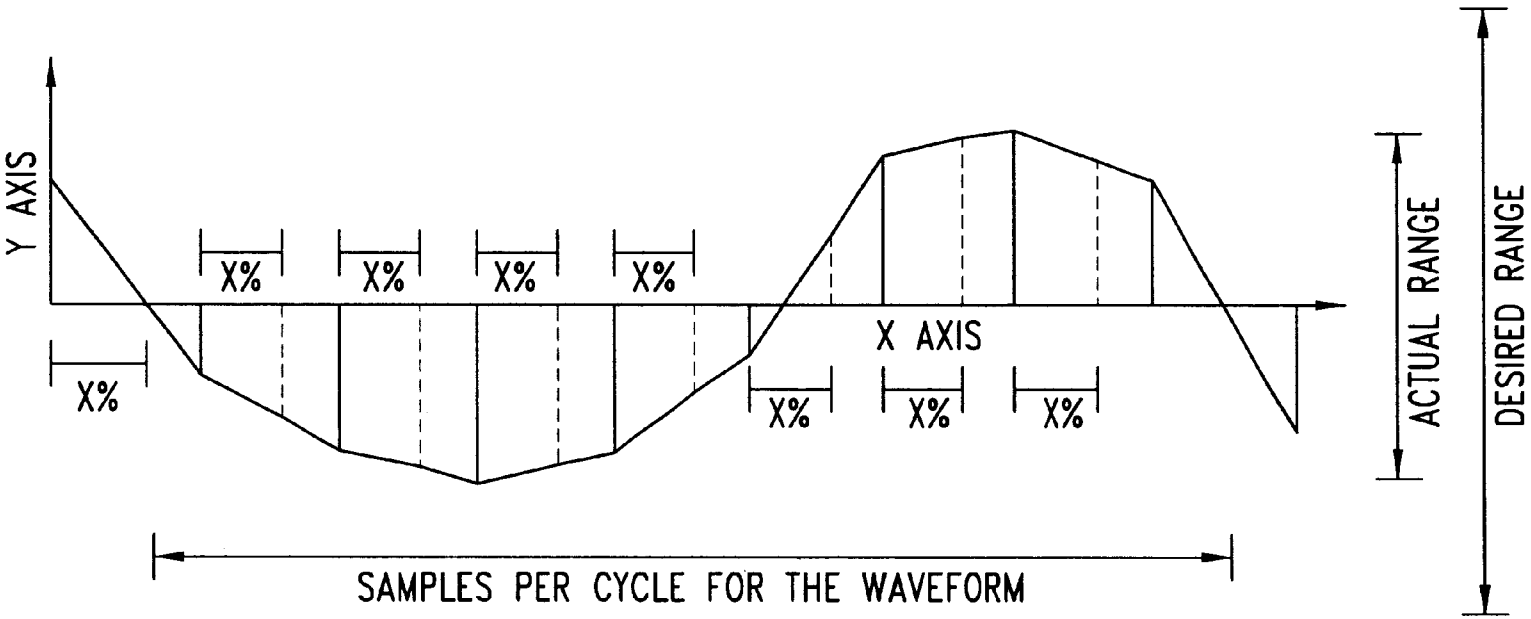
FIG. 16 illustrates an embodiment of a process for normalizing note samples.

FIG. 16 depicts details of operations in the process of normalizing samples before storing them in the database. The sequential sample numbers are plotted along the X-axis (e.g., samples 1–n) and the sample values are plotted along the Y-axis. The figure is a graph of the first part of the sample values as extracted from digital sample value files [DS1], with a zero crossing point between the first and the second sample. There is a similar zero crossing point between the second to last and the last sample. Clearly, the duration or the span of the actual cycle in the example of FIG. 16 is from the first crossing point to the last crossing point. And in general that span will consist of a certain number of sample values and a fractional value. The first step is to find the fractional or percentage points (shown as "X%" in FIG. 16) at which the graph crosses the X-axis at both ends of the cycle and compute the exact duration in terms of an integral and a fractional number of samples per cycle(spc). The frequency value (i.e., cycles per second(cps)), is then obtained by dividing the sampling rate (Samples per second or "sps") by the samples per cycle, or (cps)=(sps)/(spc).

The notes recording facility [CF1] (see FIGS. 1 and 14) records data samples from the external source (e.g., [ES1]). As those skilled in the art can appreciate, there is no synchronization between the external music source and the start of the data sampling process with the notes recording facility [CF1]. Thus, the first data sample rarely, if ever, coincides with the precise start of a waveform cycle. This is illustrated in FIG. 16 where the beginning of a cycle (i.e., the first zero crossing) occurs between the first and second samples. The next step is to normalize the samples by first interpolating the values so that the first point on the plot of the sample values lies on the "x" axis (i.e., has a value of zero). This gives the value of 0 to the first sample. This is desirable from the point of view of synthesizing musical phrases from the sample values, so that the transition from note to note starts with a smooth connection between the sample values for the two notes. This is achieved, as indicated in FIG. 16, by first computing the value (X%) at which the zero crossing between the first and the second values (shown as solid lines) occurs. The next step is then to interpolate the values (shown as dashed lines) at X% between successive pairs of sample values (shown as solid lines), until the end of the cycle is reached. In this manner, the shifted waveform will always start with a zero value and avoid distortion and errors due to discontinuities at the start of the cycle. However, as those skilled in the art can appreciate, this shifting process may result in a discontinuity at the end of the waveform. For example, the zero crossing at the start of the cycle may be 60% (i.e., 0.6) of the way between the first sample data point and the second sample data point. In contrast, the zero crossing at the end of the cycle may be 80% (i.e., 0.8) of the way between the last two data samples. A waveform shift of 60% (the present example) will result in a discontinuity at the end of the cycle. The difference in the zero crossing points at the beginning of the cycle and the end of the cycle is referred to herein as the fractional value. In the present example, the start of the cycle is 60% of the way between the first and second data sample points while the zero crossing at the end of the cycle is 80% of the way between the last two data example points. The fractional value in this example is 20% (i.e., 80%–60%). The data sample values for the shifted waveform (i.e., the first data value corresponds to the zero crossing at the start of the cycle) are stored in the database tables along with the fractional value (e.g., 20% or 0.2). When generating an output waveform, the CSDWS will use the fractional value to generate a number of time shifted waveforms depending on the fractional value. This process will be described in greater detail below.

The last step in normalizing is to adjust the sample values so that the maximum range between the largest positive value and the largest negative value (labeled as "Actual Range") is the same as a predefined value so that all the note samples play at the same volume or loudness. This is achieved by first obtaining the "Actual Range" by scanning for the highest positive and negative sample values, obtaining the range, and then determining the ratio of "Desired Range"/"Actual Range". This ratio may be smaller or larger than 1, depending on the volume at which the note samples are recorded as compared to the desired volume. Once this ratio is obtained, every interpolated sample value is multiplied by the ratio, and the resulting number is stored in the database table as the sample value to be used by the synthesizing process. The process is complete when all other data values, as identified in FIG. 11, and explained in section 1.2.1 are stored in the database tables, for all the desired notes for all the desired sound type.

1.3 Facilities for Using the Synthesizer to Generate PCM Waveform Music Files Sections 1.1 and 1.2 have described in detail the principles behind and the processes involved in building an embodiment of the CSDWS as identified in this document. This section presents a description of how to build some facilities for using the synthesizer to create musical phrases. Of course, the synthesizer may generate music files in a manner other than that described herein but which would be readily apparent to one of ordinary skill in the relevant art. As a result of identifying and capturing the atomic or fundamental unit required for digitized music, the possibilities are endless. Conceivably, any type of music can be constructed, using appropriate algorithms to manipulate the data units. In this section we will identify algorithms for two fundamental operations that will be required in creating any type of music. Those operations are, (1) creating the music file producing a sound corresponding to a specific note of a specified duration, of a specific music type played at a constant volume, and (2) creating the music file producing a sound corresponding to a series of notes, each of a specific duration, of a specific music type played at a constant volume. The principles behind these operations will be identified first. This will be followed by descriptions of possible embodiments using the appropriate components identified in FIG. 1.

It should be noted that all the algorithms for creating music files are contained in the Music File Generation Module in the component SVPS (see FIG. 1). In an embodiment, this component is implemented as a dynamic link library ("DLL") with an appropriate application programming interface ("API") exposing the appropriate functions that can be called by the various software modules as required. This is an open and extensible component. DLLs allow executable routines to be stored separately as files having DLL extensions that are loaded only when needed by a program. A DLL routine consumes no memory until it is used. Because a DLL routine is a separate file, a programmer may make connections or improvements to the routine without affecting the operation of the calling program or any other DLL routine. In addition, a programmer may use the same DLL routine with other programs. The API specifies the manner in which facilities provided by the DLL can be used by programs using the DLL.

We will start by describing some general considerations for creating PCM waveform music files.

1.3.1 Creating PCM Waveform Music files: Algorithm 1.2

The specification for the PCM Wavefile Format is completely described in document titled "Multimedia Programming Interface and Data Specifications 1.0" issued jointly by IBM and Microsoft, in August 1991. The file consists essentially of a header followed by the data. Each block is referred to as a "chunk". The header contains provisions for specifying parameters such as Mono/Stereo, 8 bits/16 bits, different sampling rates (11.025 kHz to 44.1 kHz), and some provisions for customizing the contents by adding user-specific information in user-definable "chunks". Many development systems such as Microsoft Visual Basic for example, provide APIs that facilitate the creation of PCM Wavefiles as well as other multimedia files. However, such files can also be created by directly writing to a standard file opened in binary writing mode. Those skilled in the art will recognize that existing programming formats, such as PCM Wavefile Format and existing APIs and standard binary files are two of many alternative possible techniques for specifying data waveforms. In an exemplary embodiment, the present invention has adopted the approach of writing such files directly in the binary mode using the appropriate functions available in the Music File Generation Module in the component SVPS. The approach works in 3 steps as follows.

Step 1: Open a new file in binary write mode and write the fixed header information and create placeholders for the statistical information that depends on the contents and the size of the data.

Step 2: Append the data in appropriate chunks at the end of the header information, collecting the statistical information that needs to be added into the header section.

Step 3: Update the header information with the collected statistical data and close the file.

This is the common procedure used for creating all PCM Waveform files in an exemplary embodiment. Therefore, the subsequent sections will only describe step 2, the creation of the data proper for the music files generated.

1.3.2 Creating the Music File Producing a Sound Corresponding to a Specific Note of a Specified Duration, of a Specific Music Type Played at a Constant Volume This is the basic step in using the synthesizer and is required in producing any type of music.

1.3.2.1 Characteristics of Single Note Constant Volume Wavefiles

It is useful to study the characteristics of single-note constant-volume wavefiles, before defining an algorithm for generating the same. FIGS. 2, 3, 4, 6, 7, 8, 9 and 10 are graphical portrayals of the waveshapes corresponding to the data in such files. Just as we extracted one or more cycles out of such a file in component [DS1], we can reverse the process and build the file by repetitive writing of the cycle(s) in the data section of the file to build it back. And in general that is true as long as we take care of a couple of items.

The first item is that the fractional part of the samples per cycle value for the note does not permit simply writing the sample values from the first to the last in a loop over and over again until the desired number of samples required to cover the span of duration at the specified kHz rate is reached. If only the one cycle of the waveform stored in the database tables were played out repeatedly, there would be a discontinuity at the end of each cycle due to the fractional value. The fractional value causes a discontinuity at the end of each cycle and that is distinctly heard as a click or other non-musical noise of some kind when such a file is created and played through a sound card. To eliminate such discontinuities, the CSDWS automatically generates a number of waveforms having different time shifts based on the fractional value. These shifted waveforms can be readily generated based on the original waveform stored in the database table. The appropriate set of "shifted" sample values are created using the Algorithm 1.1 as outlined in section 1.2.4 and depicted in FIG. 16. These shifted sample value sets are used sequentially in a loop for successive cycles of the note.

For example, if the fractional value for the samples per cycle number is 0.2 or $2/10^{th}$, then a series of shifted waveforms have to be generated with shifts of 0.2, 0.4, 0.6, and 0.8 cycles, respectively. These values are then used in a loop in the order, zero-shift (i.e., the basic cycle stored in the database table), 0.8 cycle shift, 0.6 cycle shift, 0.4 cycle shift, and 0.2 cycle shift, followed again by the zero-shift cycle and so on. When the first cycle (i.e., the basic cycle stored in the database table) is played, there is a discontinuity at the end of the cycle (0.2 cycles in the present example). However, the next cycle generated by the CSDWS is shifted 0.8 cycles with respect to the basic cycle stored in the database table so that the first sample data value of the second cycle has been shifted to correspond with the discontinuity of the previous cycle and thereby create a smooth transition between sample values. Because of the 0.8 cycle time shift of the second cycle, there is a different discontinuity at the end of the second cycle (0.4 cycles in the present example). However, the third cycle generated by the CSDWS is shifted 0.6 cycles to form a smooth transition with the previous cycle. This process continues until the CSDWS generates the cycle with the 0.2 cycle shift. This cycle ends with the last data value coinciding with the zero crossing at the end of the cycle. Thus, the CSDWS automatically generates a number of cycles of the basic waveform each with a different shift to generate a resultant waveform whose beginning and end data values coincide precisely with zero crossings of the waveform Once that is done, the discontinuities go away and the note sounds continuous.

The example presented above required five cycles of the basic waveform with various time shifts (i.e., 0.0, 0.8, 0.6, 0.4, and 0.2) to produce a set of data sample values that coincide with the zero crossing at the beginning of the cycle (in the 0.0 cycle) and at the end of the cycle (in the 0.2 cycle). Thus, the CSDWS will always generate waveforms with a 20% fractional value in groups of five cycles. As those skilled in the art can appreciate, other fractional values will result in a different number of cycles having different time shifts. For example, a 50% fractional value only requires the generation of two cycles (a 0.0 shifted cycle and a 0.5 cycle) to produce a set of sample data values that coincide with the zero crossing at the beginning of the cycle (in the 0.0 cycle) and at the end of the cycle (in the 0.5 cycle). The examples provided above calculate time shifts in tenths of cycles. Those skilled in the ail will recognize that other shift factors can also be implemented by the CSDWS. For example, the CSDWS can calculate the fractional value in hundredths of cycles. If, for example, a waveform sample has a fractional value of 0.25, then a set of four cycles (i.e., 0.0, 0.75, 0.50 and 0.25) would be automatically produced to eliminate any discontinuities in the waveform. The present invention is not limited by the specific accuracy of fractional values.

It should be noted that if the fractional value is non-existent (actually set to 1, as explained in section 1.2.1.1), this problem does not arise, and the first to the last sample values can simply be stacked one after the other in the data section.

The second and somewhat more serious problem arises at the beginning and at the end of the note. If the full amplitude of the sound (i.e., the actual values of samples) is used from the beginning of the data section of the file, a jerky or jarring sound is heard. This can be overcome by assigning a certain time duration for the beginning of the note or the "attack segment" as it is called in digital music vocabulary and building up the amplitude (i.e., is the data values of the samples) gradually from zero at the beginning of the attack section to the full value at the end of the attack section. The variation can follow any mathematically definable curve, the simplest one being the linear type. An appropriate curve giving the desired sound characteristics can be selected. The algorithm described uses a linear variation. However, those skilled in the relevant art will be able to replace it with any other desired type of variation. The same consideration applies at the end of the note or the "decay section" where the sound of the note gradually dies down instead of stopping suddenly. In that case, a linear variation from the full value to zero over the desired number of samples is implemented.

1.3.2.2 Musical Note Creation Algorithms: Algorithms 1.3 and 1.4

Figure 17:
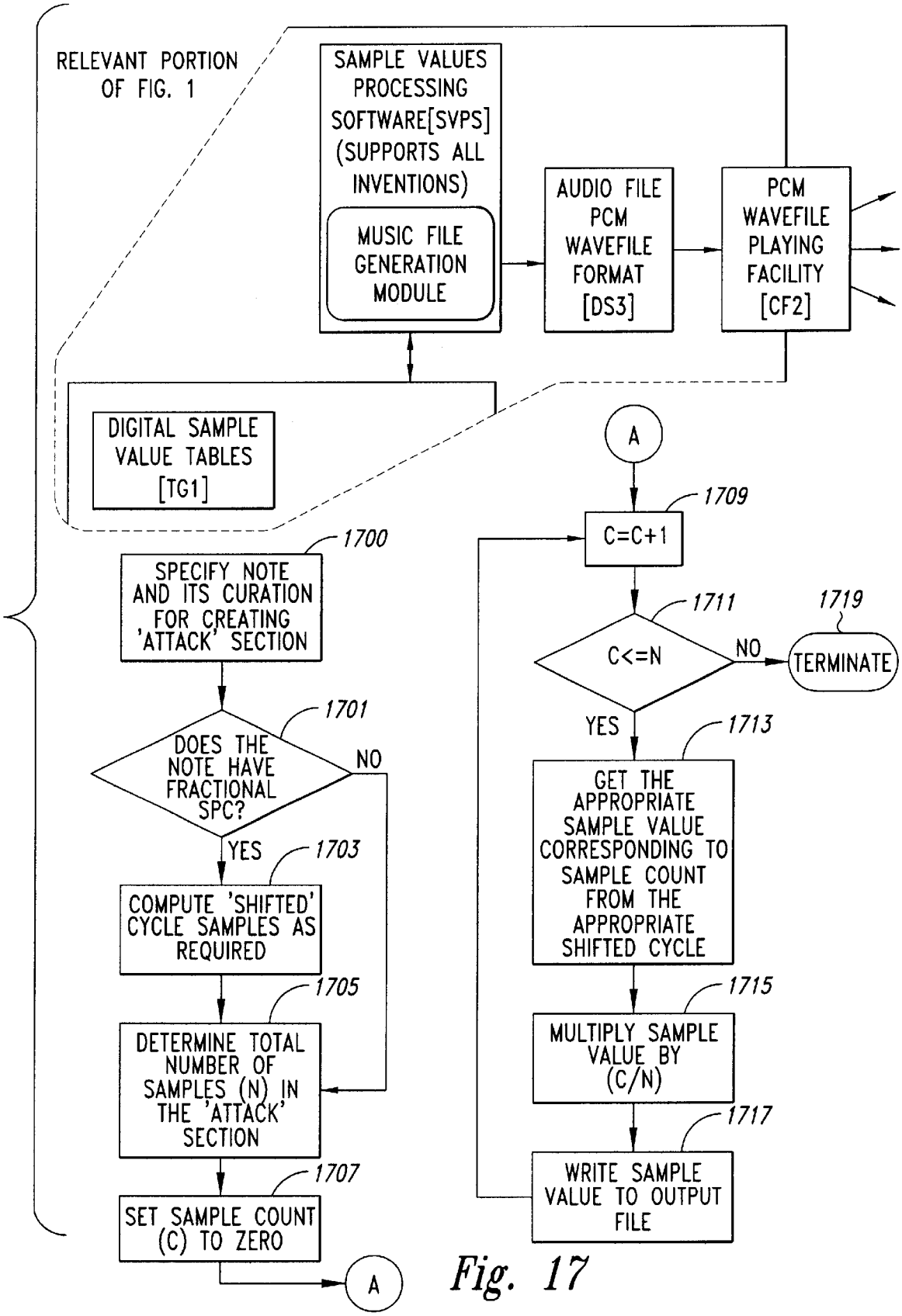
FIG. 17 is a flow chart illustrating an embodiment of a process of generating an "attack" section of a note.

FIG. 17 is a flowchart for the "attack" process (Algorithm 1.3) of a single note, as implemented in one embodiment. An attack is the act or manner of beginning a musical tone or phrase. The process is carried out by the sample values processing software [SVPS], which generates the audio file from the digital sample value tables in the database (see FIG. 1). For ease in understanding the invention, the relevant portions of the system illustrated in the functional block diagram of FIG. 1 are also portrayed in FIG. 18. The process is carried out as follows.

The user specifies the musical note and the duration or the length of the 'attack' section. (step 1700).

If the specified note has a fractional value for its frequency in terms of 'samples per cycle' (step 1701), then the appropriate set of 'shifted' cycles as described in section 1.3.2.1 are computed (step 1703).

The program then determines the total number of samples 'N' for the duration of the 'attack' section (step 1705) and initializes the loop counter 'C' (step 1707). The loop (step 1709 through step 1717) is then executed as follows.

The loop counter is incremented by 1 (step 1709).

If the counter has not yet reached the limit value 'N' (step 1711), then the appropriate sample value form the appropriate shifted cycle is obtained (step 1713) and multiplied by the factor 'C/N' (step 1715).

The resulting value is then written out to the output file (step 1717), and the program returns to the beginning of the loop (step 1709). When the counter reaches the limit value 'N' , the process terminates (step 1719).

Creating the sustain portion is a simple operation and its flow chart is very similar to the flow chart in FIG. 17, except for the process of multiplying the sample value by the ratio (Sample Count/Number of Samples) (step 1715). That step is not used.

Figure 18:
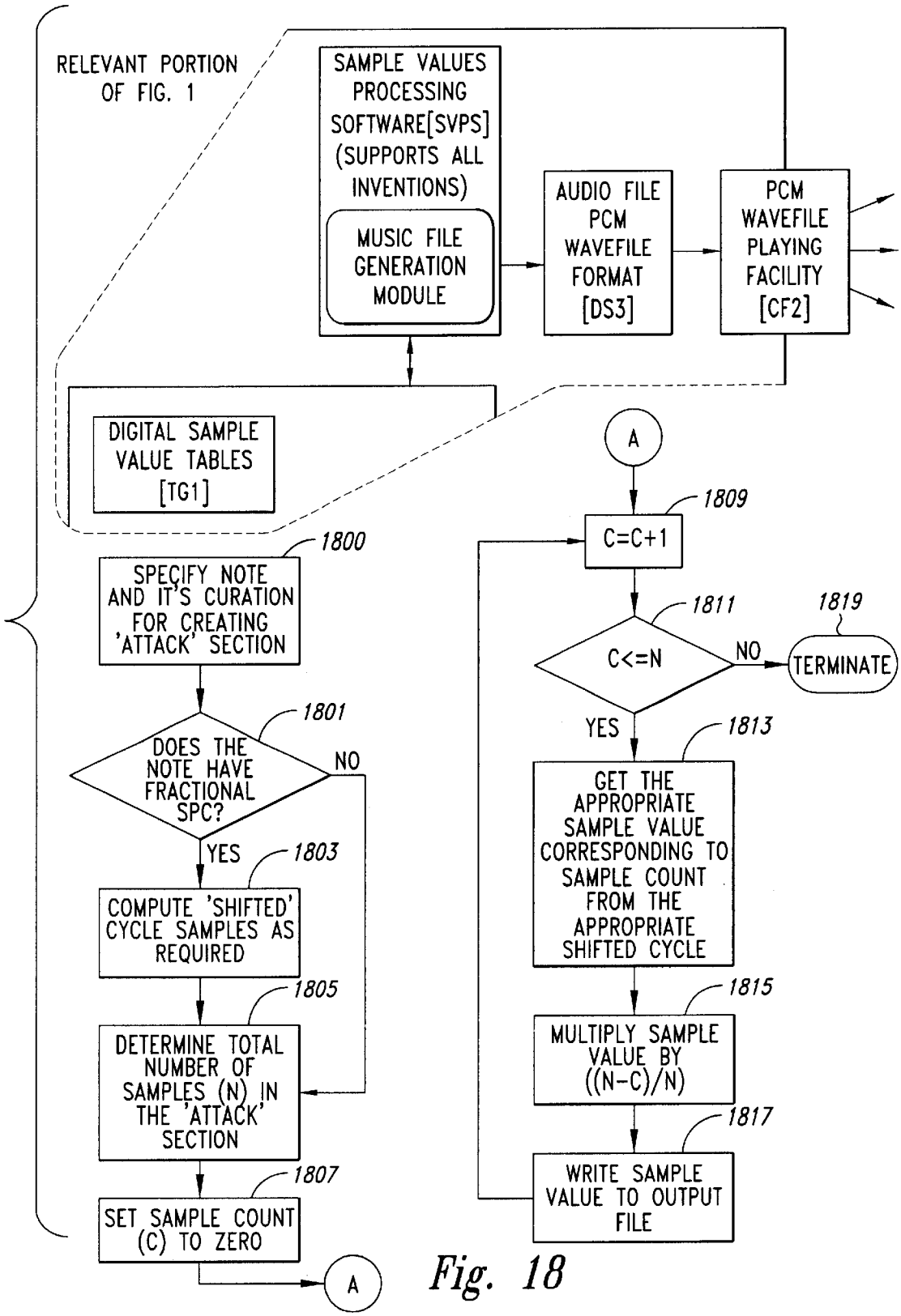
FIG. 18 is a flow chart illustrating an embodiment of a process of generating a "decay" section of a note.

Creating the decay portion (Algorithm 1.4) of a single note is the reverse operation of creating the "attack" segment (Algorithm 1.3), and its flow chart is depicted in FIG. 18. Decay refers to a decrease in the relative volume or force of a musical tone or phrase. The relevant components of the functional block diagram of FIG. 1 are also included in FIG. 18 for ease in understanding the decay process.

The process for Algorithm 1.4 (FIG. 18) is identical to the process for Algorithm 1.3 described above, except in step 1815, (which corresponds to step 1715 in FIG. 17), and the multiplication factor in step 1815 is '(N-C)/N' as against 'C/N' in step 1715. For the sake of brevity, a discussion of those steps will not be repeated herein.

Figure 19:
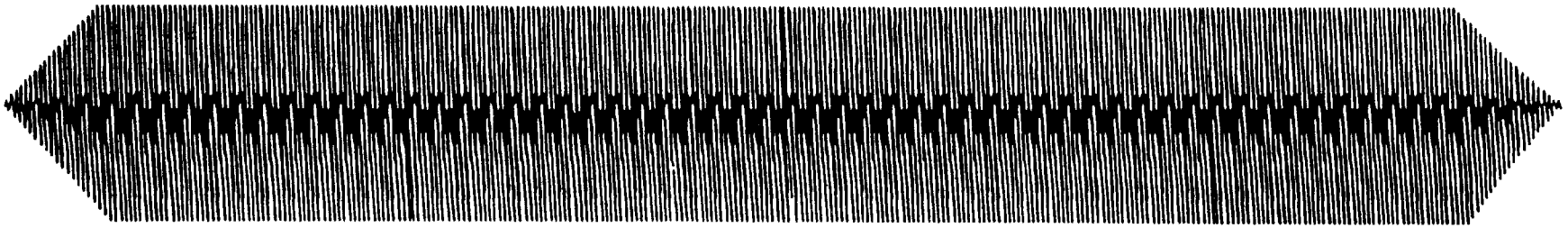
FIG. 19 is a synthesized waveshape diagram for a note.

FIG. 19 is the plot of the generated wavefile using all the above algorithms and clearly shows the shapes of the "attack", "sustain" and "decay" segments of a given duration. Sustain refers to maintaining a musical tone or phrase at a given volume or force.

1.3.3 Creating the Music File Producing a Sound Corresponding to a Series of Notes, each of a Specific Duration, of a Specific Music Type Played at a Constant Volume The algorithm for creating a music file for a series of notes is a straightforward extension of the algorithm specified in section 1.3.2 above. In this case, the wavefile data for each note, complete including the "attack", "sustain", and "decay" segments is generated and is written sequentially to the data section of the wavefile. This type of synthesis leads to a smooth transition between the notes.

A variation to this algorithm is possible where the decay section of the previous note and the attack section of the current note are written in a partially overlapped manner. This results in a slightly different audible pattern for the transition from note to note. Use of this variation permits the user to adopt an approach that is most suitable in terms of the desired audio characteristics of the application.

Figure 20:
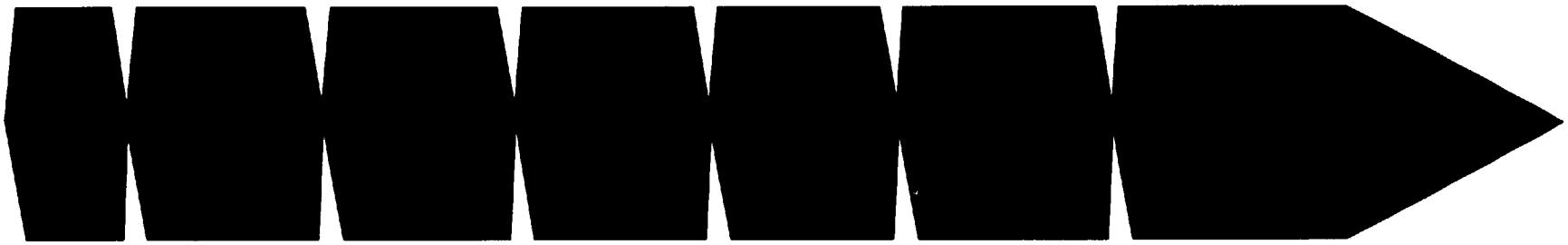
FIG. 20 is a synthesized waveshape diagram for a series of notes.

FIG. 20 shows the waveform data plot for such a series of seven notes played sequentially, with each of the seven notes having about the same duration except for the last note, and with no overlap between the "decay" section of the previous note, and the "attack" section of the current note. Because of the very large number of samples involved, (the size of the file was 650 Kbytes) the plot for each note appears as a solid bar rather than a wavy shape. However, the "attack" and the "decay" sections for each note and the prolonged "decay" section of the last note are clearly seen.

1.4 Algorithms for Producing the Desired Special Musical Effects.

Up to this point, we have identified two fundamental algorithms (Algorithms 1.3, and 1.4) used in simulating the playing of a single note for a given duration in section 1.3.2, and simulating the playing of a series of notes, each of a given duration, with smooth transition from note to note, in section 1.3.3. These simulations reproduce the staccato style playing of a series of notes of constant pitch and volume. A few specialized ways of using musical notes in Indian classical music will be briefly described below. They are, Use of Quarter Tones (section 1.4.3), use of Grace Notes (section 1.4.4), and use of Oscillatory patterns (section 1.4.5). Additionally, two other important aspects of Indian Classical music are described below. They are, use of the Drone (section 1.4.6), and use of Rhythm and Tabla (section 1.4.8). This section will describe these effects, and the algorithms developed for achieving these effects.

To more completely understand some effects commonly used in Indian Classical music and implemented by the present invention, it would be helpful to explain some musical nomenclature and fundamental concepts of Indian Classical music. This is done in sections 1.4.1, 1.4.2, and 1.4.3.

1.4.1 The Tonic Note

The Indian classical music form is firmly founded upon the concept of the tonic note or the base note. The pitch of the tonic note is not fixed in terms of the absolute frequency of the note, (such as the note "middle C" in Western music vocabulary having a fixed frequency.) Octaves of notes are then interpreted with respect to that note. In other words, any note that is suitable with respect to the range of notes that the music-generating medium can produce is chosen as the tonic note.

1.4.2 Identifying and Naming Notes:

Starting from the note C on a keyboard, and playing the next seven white notes up to the note C an octave above in succession, one obtains the major scale. The seven intervals between these eight notes are 1, 1, ½, 1, 1, 1, and ½ notes. The fundamental or the basic octave used in Indian music has the same intervals between the notes. Thus, using any note as the tonic note, if these intervals are applied, one gets the basic scale used in Indian music for that tonic note. The tonic note is identified with the name Shadja or Sa. The names of the successive notes in the basic scale are, Rishabh or Re, Gandhar or Ga, Madhyam or Ma, Pancham or Pa Dhaivat or Dha, and Nishad or Ni. The next note is then the upper Shadja or Sa. Considering the semi tones, the semi tone between Sa and Re is identified as komal or flat Re. The note between Re and Ga is identified as Komal or flat Ga. There is no semi tone between Ga and Ma, as these two notes themselves are a semi-tone apart. The note between Ma and Pa is identified as teevra or sharp Ma. The note between Pa and Dha is identified as Komal or flat Dha, and the note between Dha and Ni is identified as Komal or flat Ni. There is no semi-tone between Ni and upper Sa as again they are a semi-tone apart. This accounts for all the 12 notes that you find in an octave on a keyboard. The notes Sa and Pa have no variations. The notes Re, Ga, Dha and Ni have a flat variation, and the note Ma has a sharp variation.

Figure 21:
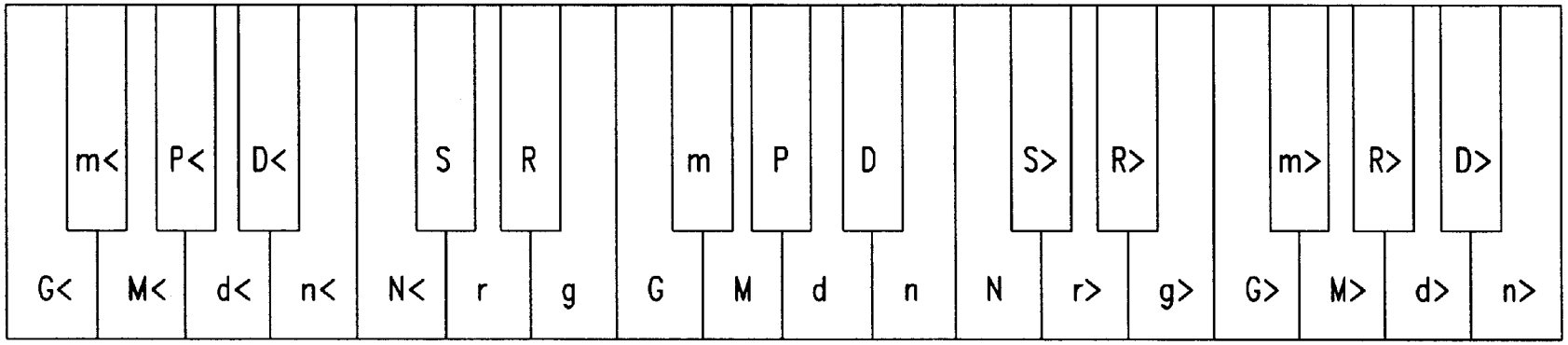
FIG. 21 is a diagram showing the layout of a keyboard and illustrates the scheme used for identifying notes, as well as the concept of the Tonic Note.

The first letter of the name of each note is used to identify the note. Whenever the note has two forms, the lower case letter is used to identify the note with the lower of the two frequencies while the upper case letter is used to identify the note with the higher of the two frequencies. Thus starling with S for Sa, the 12 semi tones in an octave are identified as S, r, R, g, G, m, M, P, d, D, n, and N. Further, the corresponding notes in the lower octave are identified by appending the "<" sign to the name of the note, while the corresponding notes in the upper octave are identified by appending the ">" sign to the name of the note. The note next to "N" will thus be identified as "S>", and the note below "S" is identified as "N<". FIG. 21 illustrates this method of naming notes with the note C# selected as the tonic note or "S".

1.4.3 Raga as the Basic Framework

Indian Classical Music is based on the basic concept of a Raga. Each Raga is based on a skeletal framework of notes within an octave. The framework specifies the notes within the octave that are to be used. Further, the ascending and descending sequences of the notes are defined in Aroha and Avroha. In some Ragas, all the notes are used in a straight up and down manner. However, many times certain notes from the group of the selected notes are omitted from the ascending or the descending pattern. Also the notes are not always sequenced in a straight up and down manner but are used with short undulating up and down patterns within the ascent or the descent.

1.4.4 Rhythm and Tala

As the Indian Classical Music itself pretty much strictly adheres to the melodic form, the counterpoint is provided by rhythm. Some kind of rhythm is incorporated in most parts of the presentation. The main rhythmic aspect to consider is "Tala".

A Tala is defined as a rhythmic cycle of certain number of beats. The Tala is played on a percussion instrument such as Tabla (actually a pair of drums, each with an open end covered with a skin membrane. One of the drums produces higher pitch or treble tones and the other one produces lower pitch or base tones), or Pakhawaj (a single drum with both open end covered with skin membranes. Again one side produces treble tones while the other side produces base tones). Ancient treatises on music identify definitions of several Talas consisting of as few as 4 beats per cycle to over 100 beats per cycle. Most of these are currently considered as merely of academic interest and are not used. The current practice uses about ten or so Talas, ranging from 6 beats ("Dadra") at the low end to 16 beats ("Teentaal") at the high end. Many beats in a given Tala may be subdivided into 2 or 4 divisions with a different sound produced at each on those sub-intervals. All sounds produced by the Tabla have their verbal counterparts and can be recited by mouth. In fact, Talas are described using the verbal pronunciation of the sounds that are produced in a complete cycle of the defined number of beats for the Tala.

We now begin to describe the special musical effects used in Indian Classical Music and the algorithms developed for producing them. They are described in sections 1.4.5 through 1.4.11.

1.4.5 Use of Quarter Tones:

Even though the primary scale used in Indian classical music uses the semi-tone-based 12-note octave as the basis, the use of quartertones is not uncommon. In fact, the ancient treatise on Indian classical music identifies a total of 22 notes, called as "shrutis", in an octave. Out of these 22 notes, 7 notes are identified as the major notes in the octave as described in section 1.4.2. The remaining 15 shrutis are then assigned as variations of these seven major notes. Thus, the note R might have 3 variations, and the note G may have 4 variations and so on. Thus, all the quartertones are specifically identified as a variation of a major note.

1.4.5.1 Algorithm for Producing Quarter Tones (Algorithm 1.5)

Figure 22:
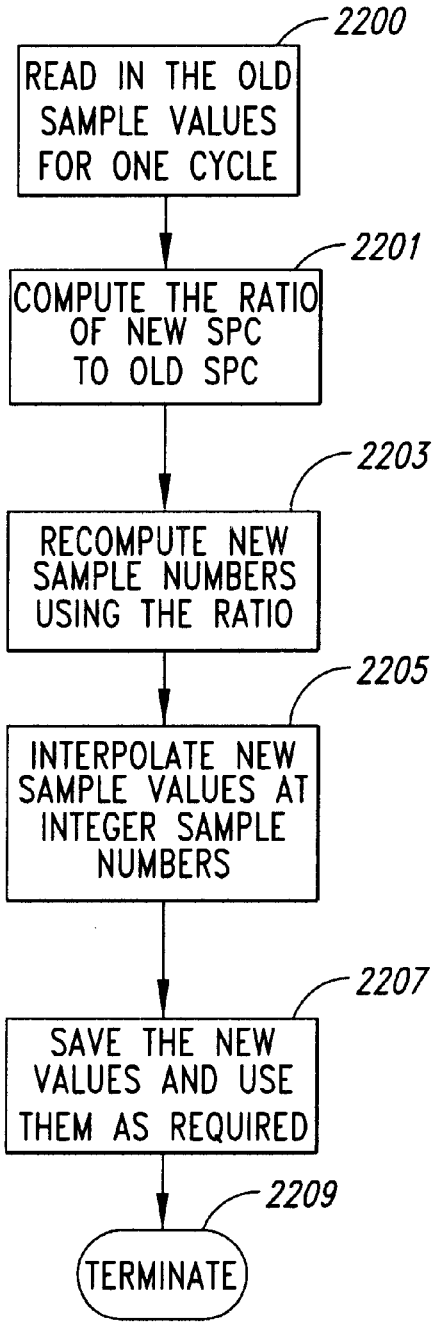
FIG. 22 is a flowchart of the operation of the present invention to perform the process of transforming a waveform from one frequency to another frequency.

FIG. 22 is a flowchart of the general algorithm (Algorithm 1.5) for transforming a waveform from its original frequency value (expressed as samples per cycle, which can be converted uniquely to the more natural cycles per second specification) to another value (also expressed as samples per cycle). This algorithm is used to create waveforms of quartertones from the closest neighboring waveforms. The process essentially compresses or expands the waveform like the bellows of an accordion, so that the compressed or expanded waveform now spans the required new number of samples for 1 cycle. The values at integer sample numbers are then interpolated and used as the definition of the transformed waveform.

The "Sample/per/cycle" (SPC) values for the Old Waveform and the New Waveform are supplied to the program as parameters.

The sample values for the Old Waveform are read in (step 2200).

The ratio of 'New SPC'/'Old SPC' is computed (step 2201).

The read in sample values are factored by the computed ratio. (step 2203). These factored sample values now represent the sample values at Sample Numbers (0, 1*ratio, 2*ratio, . . .) instead of at Sample numbers (0, 1, 2, . . .) for the old samples.

The new values are used to interpolate the values at the new integral sample numbers (0, 1, 2, . . .) (step 2205).

The new values are saved in memory and used as required (step 2207).

The process terminates after all the sample values are saved in memory (step 2209).

Although the process of FIG. 22 describes the process of generating notes and quarter-tone intervals, the same algorithm (Algorithm 1.5) may be readily used to implement notes at any user selected interval. Quarter-tone intervals are described in the present example only because that musical interval is relatively common. Furthermore, because Algorithm 1.5 allows the generation of musical notes at any user-selected interval, the basic set of samples can be obtained at musical intervals other than semi-tones. The examples provided herein are directed to semi-tones because that musical interval is so common in music. However, the present invention is not limited to the use of samples at semi-tone intervals.

1.4.6 Use of Grace Notes

Grace Notes or smooth glides from note to note (also called as the portamento effect in the Western musical parlance) are an integral part of the presentation of Indian Classical music. Smooth glides from note to note are artfully combined with staccato form of presentation of notes. For every Raga certain glides are an accepted part of the structure of the Raga and are expected to be used. However, the use of glides is generally left to the performer.

The glides can fall into two broad categories. If the note with a glide is called as a composite note starting on one note and ending on another note, then the first category is where the glide takes place at the beginning of the composite note. The second category is where the glide takes place at the end of the composite note. Thus if the glide is from note G to note R, (See FIG. 21) then in the first category, the note G is introduced very briefly, the glide from G to R takes place in a short time duration, and the note R is sustained for the rest of the duration of the composite note. Sustain refers to maintaining a musical tone or phrase at a given volume or force. As against this, in the second category, the note G will be sustained for much of the duration of the composite note, a short glide from G to R takes place and the note R is sustained briefly at the end of the duration of the composite note.

1.4.6.1 Algorithm for Producing Grace Notes or Glides

Section 1.3.3 specifies an algorithm for creating a series of notes with smooth transition between the notes. That is achieved by terminating the previous note with a short "Decay" section, and then following up with the next note with a short "attack" section. The resulting waveform is diagrammatically shown in FIG. 20. Section 1.3.3 also suggests a variation on the algorithm, where the "decay" section of the previous note and the "attack" section of the next note overlap partially.

The algorithm for producing grace notes takes this approach to the limit with full overlap between the decay and the attack sections. Further, in order to produce a smooth glide, it carries out this transition in a series of steps where in each step, the two transitioning notes are preferably a quarter note apart from each other. As many such steps as required are taken from the starting note towards the target note until the target note is reached. Since the basic one cycle samples in the synthesizer are a semi-tone apart, this requires the generation of single cycles of notes that have a pitch in between each pair of adjacent semi-tones.

We already have defined an algorithm for transforming the waveform for one frequency to another frequency a quarter tone above or below it (Algorithm 1.5 in Section 1.4.5). So we now need an algorithm for generating the fully overlapped transition between two adjacent notes (Algorithm 1.6 in Section 1.4.6.2 below). We can then create an algorithm that uses these two algorithms 1.5 and 1.6 for producing the desired glides between any two notes (Algorithm 1.7 in Section 1.4.6.3), which is the ultimate objective.

1.4.6.2 Algorithm for Creating Fully Overlapped Transition between Notes (Algorithm 1.6)

Figure 23:
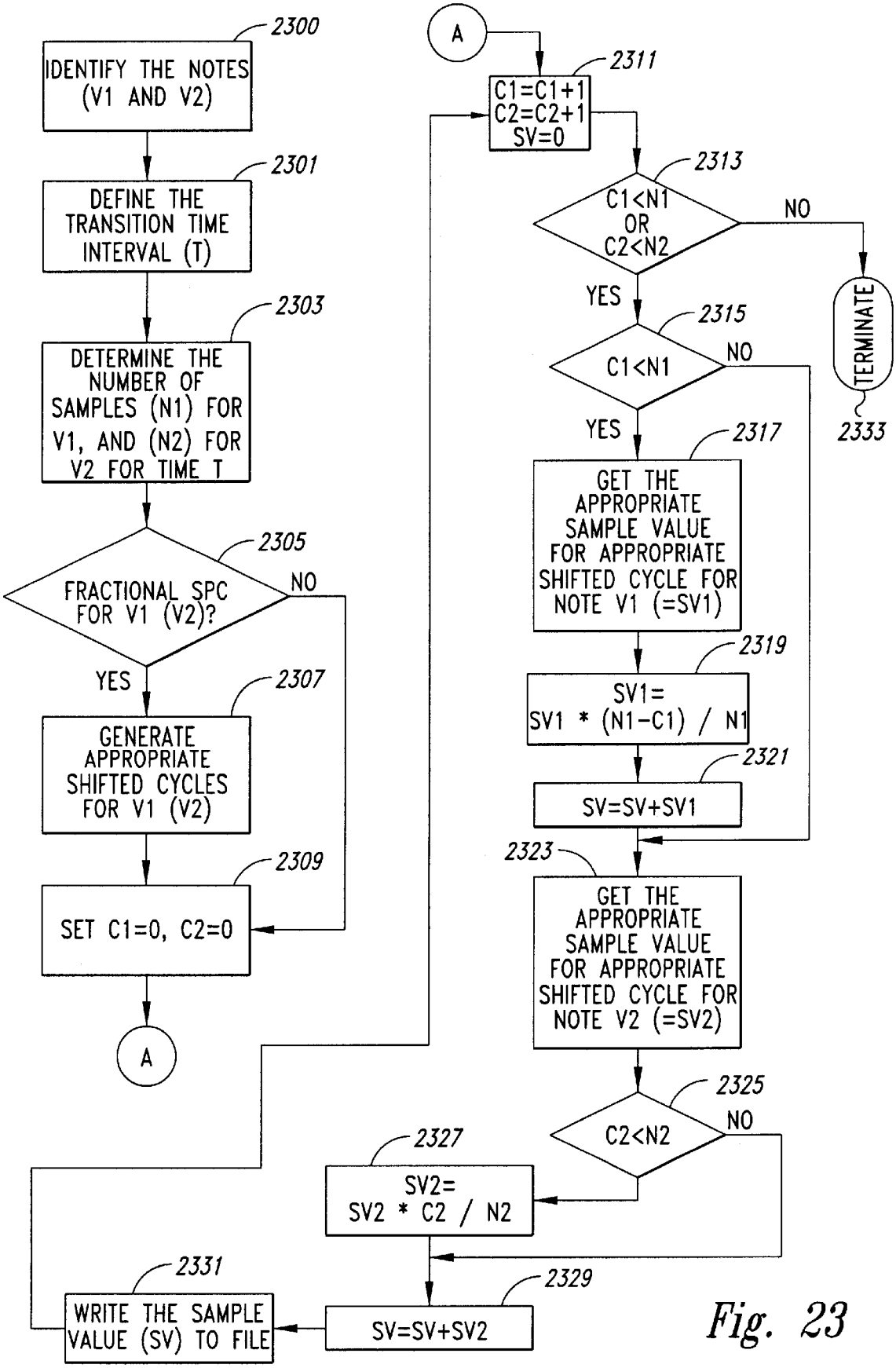
FIG. 23 is a flowchart of the operation of the present invention to generate a fully overlapped transition between two notes.

FIG. 23 is a flowchart of the algorithm for transitioning from one musical note to another note, using the fully overlapped decay and attack sections (Algorithm 1.6). The process works as follows, according to an embodiment of the invention.

The two musical notes (Note1 and Note2) to create fully overlapped transition between them are identified (step 2300).

The time interval for the transition (a default value unless supplied by the user) is defined (step 2301).

The number of samples (N1 and N2) to cover the required time interval for both the notes are computed using their frequency values (step 2303).

If either note has a fractional 'Samples Per Cycle' value (step 2305) then the appropriate "shifted cycles" are computed (step 2307). (See Section 1.3.2.1 for an explanation of shifted cycles).

The counters (C1 and C2) for the two notes are initialized (step 2309). The program then loops between step numbers 2311 to 2331 until the transition is generated.

The counters are each incremented by 1, and the sample value (SV) is initialized to zero (step 2311).

When both the counters (C1 and C2) reach their respective limits (N1 and N2) (step 2313), the process is terminated (step 2333). If either counter has not reached its limit, the following actions are performed.

If the counter C1 has not yet reached the limit N1 (step 2315) then the following 3 actions are performed:

1. The appropriate sample value (SV1) for the appropriate shifted cycle for Note1 is obtained (step 2317).

2. The value is factored by the factor '(N1−C1)/N1' representing the 'decay'ing value of the sample (step 2319).

3. The value SV1 is added to the sample value SV (step 2321).

The appropriate sample value (SV2) for the appropriate shifted cycle for Note2 is obtained (step 2323).

If the counter C2 has not yet reached the limit N2 (step 2325) then the value SV2 is factored by 'C2/N2' (step 2327) representing the 'attack'ing value of the sample.

The value SV2 is added to the sample value SV (step 2329). The sample value SV is written to file (step 2331), and the program returns to the top of the loop (step 2311).

1.4.6.3 Algorithm for Producing Glide from One Note to Another Note (Algorithm 1.7)

Figure 24:
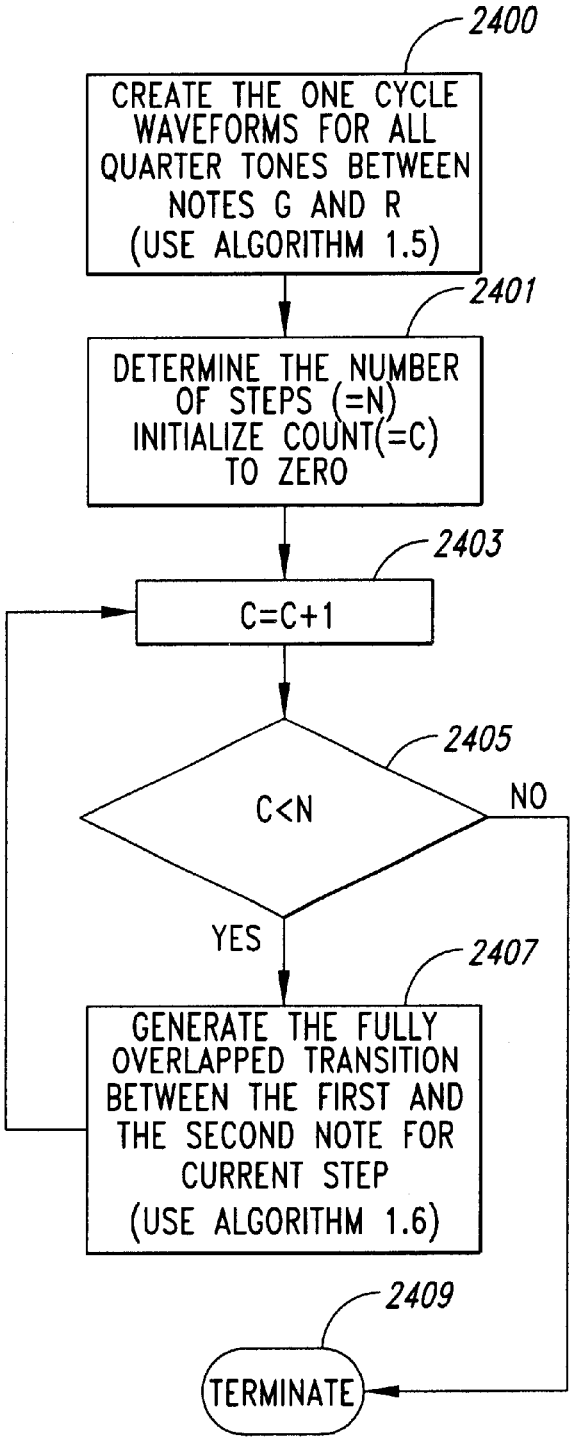
FIG. 24 is a flowchart of the operation of the present invention to generate a smooth glide from one note to another note.

FIG. 24 is a flowchart of the algorithm for producing the glide, from one note to another note, first by generating the required number of quarter tone waveforms using the algorithm 1.5, and then by calling out the fully overlapped transition between successive quarter tones using the algorithm 1.6, until the distance between the starting note and ending note for the glide is covered. The process is carried out as follows.

The two musical notes (N1 and N2) between which the glide is to be created are supplied as parameters. Knowing those notes, the waveforms for all quartertones between those notes are computed using Algorithm 1.5 (step 2400).

The number of steps (N) between the two notes N1 and N2 are computed, and the counter 'C' is initialized (step 2401). The program then loops between steps 2403 and 2407.

The counter is incremented by 1 (step 2403).

If the counter 'C' has reached the limit 'N' (step 2405) then the process terminates (step 2409).

Otherwise the transition between the two notes for the current step is computed using Algorithm 1.6 and written to the file (step 2407). The process then continues with the next iteration of the loop (step 2403).

1.4.7 Use of Oscillatory Patterns

Even though the normal patterns of producing notes is a steady note at the desired frequency or pitch with as little vibration or oscillation as possible, oscillatory patterns are used as a form of ornamentation in Indian classical music. They are like the vibrato effect but more deliberate and slower. The oscillations take place specifically between the two desired notes, which could be major notes, semi tones or quartertones.

1.4.7.1 Algorithm for Producing Oscillatory Patterns between Two Notes (Algorithm 1.8)

This algorithm is a direct extension of algorithm 1.7 above. An oscillatory pattern between musical note N1 and musical note N2 is nothing different than a series of glides from note N1 to N2 to N1 to N2 to . . . for the desired time interval that is the length of the oscillatory note. So, it can be achieved by arranging a sequence of glides between notes N1 and N2 from one to another for the desired length of time.

1.4.8 The Drone

The drone or the background sound is also an integral part of Indian Classical music. The drone is provided by a four-stringed instrument and the strings are plucked sequentially over and over again to provide the drone. Of the four strings, the second and the third are tuned to the tonic note (note "S") (See FIG. 21 for naming convention for notes) that is used by the performer. The fourth string is tuned to the note exactly one octave below the tonic note (note "S<"). The tuning of the first string depends on the notes used in the Raga being performed. If the Raga uses the note "P", the string is tuned to the note "P<". If the Raga does not use the note P, but uses the note "m" then the first string is tuned to the note "m<". If the Raga does not use either the note "P" or the note "in", then the string is tuned to the note "N<".

The drone is played continuously throughout the performance in a specific pattern. One cycle of plucking the four strings occupies an interval of about 3 seconds. However, within that interval, the strings are not plucked at equal spacing. If the first string is plucked at the $0^{th}$ second, then the second string will be plucked at second number 1, the third string will be plucked at second number 1.5, and the fourth string will be plucked at second number 2. Then the first string will be plucked again at second number 3 starting the next cycle of plucking the strings. In other words, if the total length of the cycle is "t", then the interval between plucking the first and the second string is "t/3", the interval between plucking the second and the third string is "t/6", the interval between plucking the third and the fourth string is also "t/6", and the interval between plucking the fourth string and the first string for the next cycle is "t/3". Thus the strings are plucked at time 0, t/3, t/2, and 2t/3.

All strings are plucked with equal strength so that they produce sound of a constant volume or loudness. As each string is plucked, it reaches the maximum volume or sound level over a short attack segment, is sustained at that level for a short period, and then decays gradually over a relatively prolonged decay segment. The next string is plucked before the volume of the previous string has decayed completely, so that there is an overlap of some duration between the sound of all the strings.

1.4.8.1 Algorithm for Producing the Drone Accompaniment (Algorithm 1.9)

Figure 25:
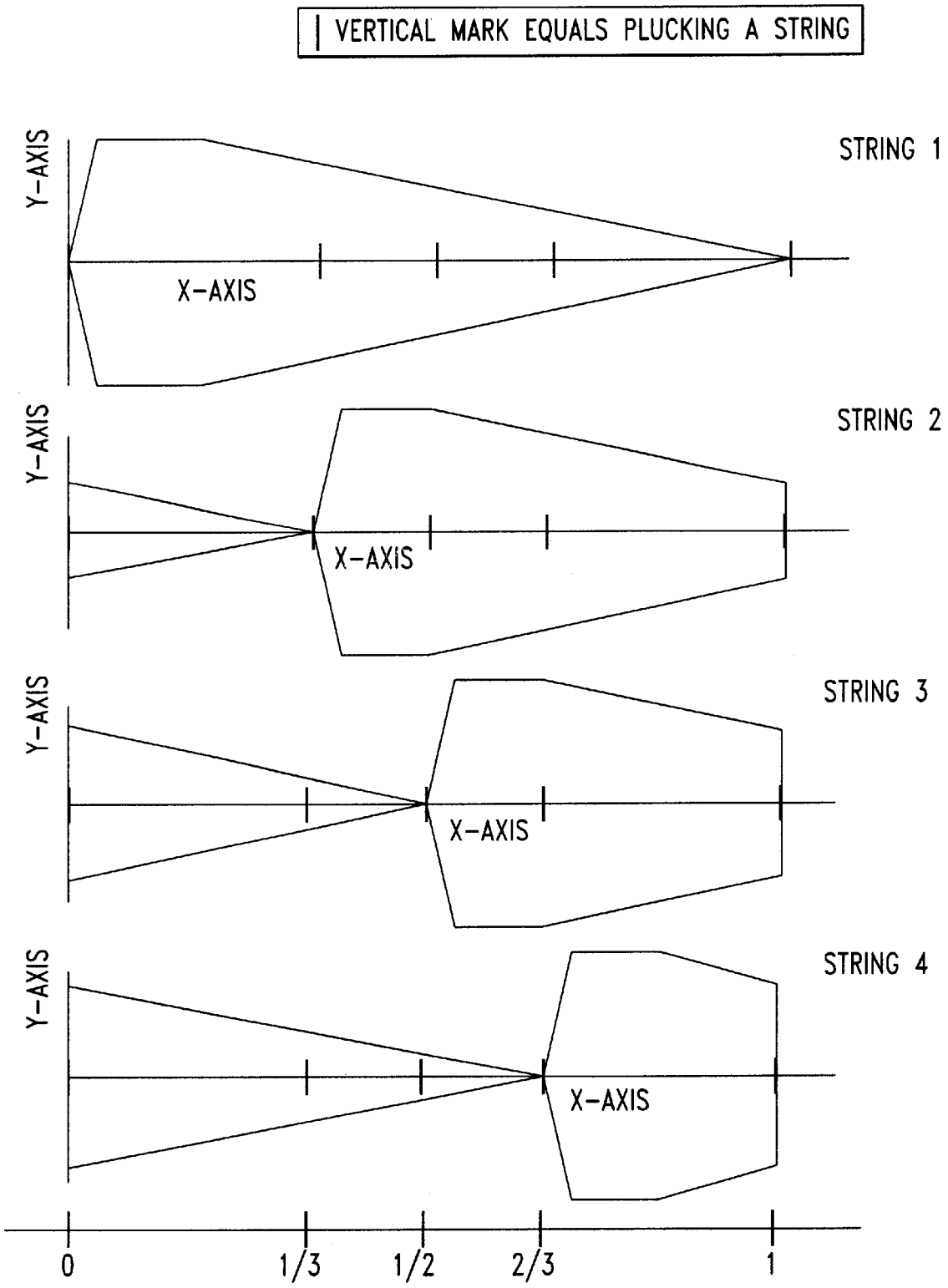
FIG. 25 is an amplitude envelope diagram of the system of the present invention to illustrate plucking of four drone strings.

Section 1.4.8 above describes the manner according to which the sound of the drone may be produced. FIG. 25 captures the essence of that description diagrammatically.

The four graphs in FIG. 25 show the amplitude or volume envelopes for the sound level of the four strings over the period of one drone cycle, starting with the plucking of the first string, and ending just before the first string is plucked again. The assumed parameters are as follows.

For the sound of each string, the length of the attack segment is $1/24^{th}$ of the length of one drone cycle. The length of the sustained portion at maximum volume is $1/8^{th}$ of the drone cycle. The length of the decay segment is $5/6^{th}$ of the drone cycle. The decay is linear, and the sound decays completely over the period of one drone cycle.

Further, the plucking of the strings occurs at times 0, t/3, t/2, and 2t/3, where "t" is the length of the drone cycle.

Section 1.4.8 also specifies the manner of tuning these strings, i.e., the pitches of the various strings with respect to the pitch of the tonic note.

These parameters allow us to devise an algorithm for producing one cycle of the sound of the drone, using the single cycle samples at the desired pitches from an appropriate source. These single cycle samples are obtained and stored in the database in exactly the same manner as for the sound used for creating music, and as described in section 1.2.

Figure 26:
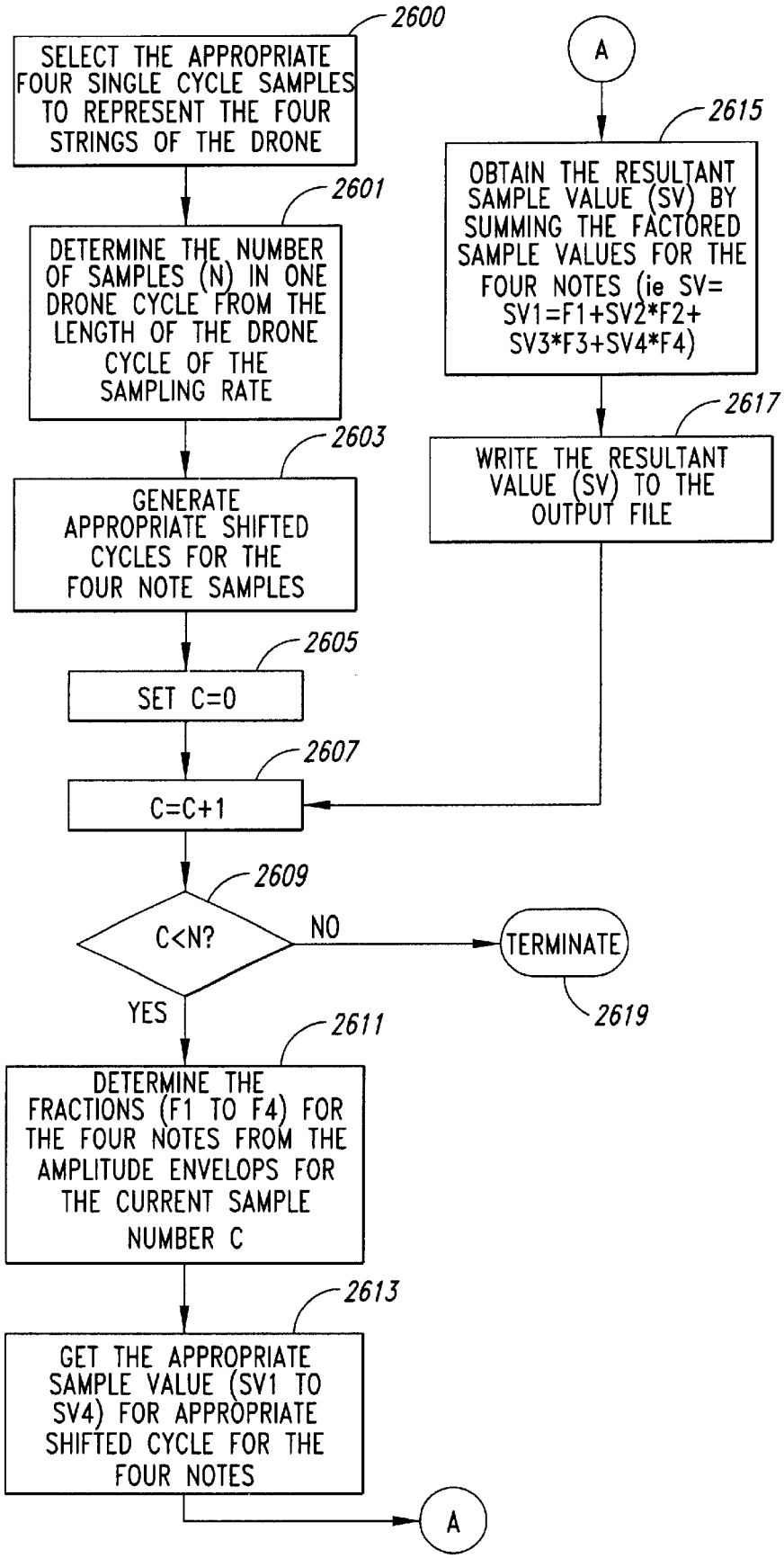
FIG. 26 is a flowchart of the operation of the present invention to generate one cycle of the drone sound.

The flowchart for the algorithm for constructing one cycle of the drone sound (Algorithm 1.9) is shown in FIG. 26.

The process begins by determining the appropriate four note samples to be used for the appropriate type of drone for the selected Raga (step 2600) (see section 1.4.8 above).

The number of samples (N) to be written for one cycle of the drone is then determined (step 2601).

The appropriate 'shifted samples,' depending on whether the 'samples per cycle' values for the notes have fractional pails or not, are then generated for each of the four notes for the drone (step 2603). (see section 1.3.2.1 for a further explanation of 'shifted cycles' ).

The counter 'C' is then initialized. (step 2605). The program then loops between steps 2607 and 2617.

The counter is incremented by 1 (step 2607).

If the counter has reached the limit 'N' (step 2609) then the process is terminated (step 2619).

The drone string amplitude envelopes shown in FIG. 24 are then used to determine the factors (F1 to F4) to be applied for each string for the current sample number (step 2611).

The appropriate sample values (SV1 to SV4) for the current sample are obtained (step 2613).

The sample values are then multiplied by the factors F1 to F4, and the resultant sample value is obtained by summing the four factored values (step 2615).

The resultant value is written to the output file (step 2617) and the program returns to the start of the loop (step 2607).

1.4.9 Playing the Drone and the Music Simultaneously

The drone and the music form two independent sources of sound that are played simultaneously in Indian classical music. This is achieved in the preferred embodiment by using the two channels of the "stereo" mode of the PCM wavefiles. The data is constructed so that the music is played on one channel, and the drone is played on the other channel. This implies alternate writing of samples for the music and the drone in the data chunk. Also the drone cycle is continuously repeated throughout the playing of the music. This is achieved by creating and storing the data for one drone cycle in memory, and looping through its samples continuously, and writing them alternately with the samples of the music sound as it is constructed and written to the data file.

1.4.10 Algorithm for Producing the Rhythmic Accompaniment (Algorithm 1.10)

Every composition in Indian classical music is set to a rhythmic structure of a cycle of a certain number of beats, and in a performance the rhythmic beat is provided by a percussion instrument, such as a Tabla. (See section 1.4.4 for a description.) Now we have three independent sources of sound, the music, the drone and the percussion instrument, going simultaneously. This is simulated in the preferred embodiment again by using the "stereo" mode, and using one channel for music and the second channel for both the drone and the rhythmic accompaniment. This is achieved by a variation of the algorithm described in section 1.4.7 (Algorithm 1.9) above. The Tabla sounds have a much faster decay rate than the decay rates of the drone strings. The notation of the composition indicates the locations at which the Tabla sounds occur. This information is sufficient to add-in the samples that correspond to the percussion sounds of the Tabla at appropriate locations and for appropriate duration in the data chunk of the output file.

1.5 Algorithms Defined in an Embodiment of the CSDWS

FIG. 27 is a listing of all algorithms defined in an embodiment of the CSDWS. They have been defined in the sections identified in the table.

1.6 Use of the CSDWS

The understanding of how a CSDWS having all the above capabilities can be used to play and also to demonstrate and teach the desired kind of music is within the scope of knowledge of a person of ordinary skill in the art. In one exemplary embodiment, illustrated in FIG. 1, the music file generation module in component SVPS in FIG. 1 has the capability to produce .wav files corresponding to musical phrase specifications consisting of a sequence of notes each with a specified duration, and including the special effects such as the 'glide' or oscillatory patterns as desired, and have them 'played' by a conventional sound card. A set of such musical phrase specifications may be created ahead of time and stored in the database DS2. Component MSAA in FIG. 1 is an example of such a facility. Then the users of a 'Music Generation Application' (component STDTICM in FIG. 1 is an example of such a facility) may interactively select the desired musical phrases from the stored set for playing. Alternatively, the users can specify the desired phrase specifications themselves interactively to the Music Generation Application, and have them played in a similar manner. The users may also be able to save the specifications created interactively by them, and have them made a part of the stored specifications, to be played again as desired. The feature of providing appropriate drone and Table accompaniment can be invoked for specifying and playing such phrases related to Indian classical music.

1.7 Alternate Embodiments

From the foregoing it will be appreciated that, although specific aspects of the invention have been described herein for purposes of illustration, various modifications may be made without deviating from the spirit and scope of the invention. For example, the digital wavetable synthesizer alternatively may differ from the system shown in the drawings.

While an embodiment of the digital wavetable synthesizer utilizes the PCM Wave file format, the invention is not limited to this file format, and any suitable file format may be utilized. Similarly, the invention is not limited to a single programming language and may be expressed in any programming language. Moreover, the graphical user interface ("GUI") discussed herein, could be replaced with a command line interface that provides equivalent functionality.

The invention may exist both as a stand-alone utility or as part of an integrated system that performs multiple functions. Moreover, various aspects of the invention may even be comprised of micro-code provided in various pieces of hardware equipment, provided that the collective operation of the system functions in the manner that has been described. In addition, a skilled programmer having knowledge of the procedures performed by the digital wavetable synthesizer and its related elements may also be able to create a system that functions in a manner similar to the digital wavetable synthesizer using other computing elements.

Although specific embodiments of, and examples for, the invention are described herein for illustrative purposes, various equivalent modifications are possible within the scope of the invention, as will be recognized by those skilled in the relevant art. The teachings provided herein of the invention can be applied to other synthesizers, not necessarily the exemplary digital wavetable synthesizer described above. Various exemplary computing systems, and accordingly various other system configurations can be employed under embodiments of the invention. The invention finds equal applicability in computing systems of any size and complexity. The invention also finds applicability in a widely dispersed network of computing devices.

All of the above U.S. patents and provisional applications are incorporated herein by reference as if set forth in their entirety.

In general, in the following claims, the terms used should not be construed to limit the invention to the specific embodiments disclosed in the specification and the claims, but should be construed to include all digital wavetable synthesizers that operate in accordance with the claims. Accordingly, the invention is not limited except as by the claims.

1.8 Copyright Notification

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

What is claimed:

1. A music synthesizer, comprising:

an input device to accept musical sounds corresponding to a single musical note from a selected musical source and to generate digital samples thereof, the digital samples containing at least one complete cycle of the single musical note;

a data buffer to temporarily store at least a portion of the digital sample containing at least one complete cycle of the single musical note;

a sample processor software module to analyze data in the data buffer and to extract therefrom one complete cycle of the single musical note, the sample processor software module further processing the extracted data to determine the frequency of the one complete cycle and to normalize the extracted data such that a first data sample in the extracted data has an amplitude of zero;

a first data structure to store the normalized data in association with a data identifier;

a second data structure to store a set of rules associated with the generation of musical notes;

a user interface operable by a user to select a sequence of musical notes;

a music file generation processor software module coupled to the user interface and receiving data indicative of the user-selected sequence of musical notes, the generation processor software module accessing the second data structure and applying rules to the user-selected sequence of musical notes to thereby generate a musical output file; and a sound board to play the musical output file.

2. The synthesizer of claim 1 wherein the first data structure is implemented with a database software program.

3. The synthesizer of claim 1 wherein the input device comprises a microphone to convert musical sounds from the selected musical instrument to electrical signals corresponding thereto to permit the generation of the digital samples.

4. The synthesizer of claim 1 wherein the set of rules comprises a specification to perform a portamento transition from a first musical note to a second musical note over a predetermined period of time, the music file generation processor software module using the specification to transition from the first musical note to the second musical note.

5. The synthesizer of claim 4 wherein the set of rules further comprise a specification for the generation of a plurality of intermediate musical notes at user-selected intervals between the first and second musical notes, the music file generation processor software module using the specification to generate a sequence of musical notes from the plurality of musical notes between the first and second musical notes beginning with the first musical note and using the sequence of intermediate musical notes during the predetermined period of time and concluding with the second musical note.

6. The synthesizer of claim 1 wherein the set of rules comprises a specification to generate a sequence of overlapping musical notes having a predetermined timing sequence in which a succeeding one of the musical notes is initiated prior to the completion of the previous musical note, the music file generation processor software module using the specification to generate the sequence in the predetermined timing sequence.

7. The synthesizer of claim 6 wherein the musical notes comprise a series of four overlapping musical notes each having an attack portion a sustain portion and a decay portion and the set of rules further specify a long decay portion for each of the sequence of four musical notes, the music file generation processor software module using the specification to sequentially initiate each of the four musical notes during the decay portion of the remaining three musical notes.

8. A music synthesizer, comprising:

an input device to sequentially accept musical sounds corresponding to a plurality of single musical notes at intervals from a selected musical source and to generate measured digital samples thereof, the measured digital samples containing at least one complete cycle of each of the plurality of single musical notes;

a processor software module to analyze the measured digital samples for each of the plurality of single musical notes and to extract therefrom one complete cycle of each of the plurality of single musical notes, the processor software module further processing the extracted data to determine the frequency of one complete cycle of each of the plurality of single musical notes and to normalize the extracted data such that a first data sample in the extracted data for the one complete cycle of each of the plurality of single musical notes at semi-tone intervals has an amplitude of zero, the processor software module further calculating a fractional value indicative of timing relationship between the normalized first data sample and a last data sample of the one complete cycle; and a data structure to store the normalized data for the one complete cycle of each of the plurality of single musical notes in association with a data identifier, wherein the data structure contains at least one complete cycle of each of the plurality of single musical notes over a selected range of musical notes for the selected musical source.

9. The synthesizer of claim 8 wherein the one complete cycle of each of the plurality of single musical notes is characterized by a plurality of measured sample data points and the processor software module determines a starting point of the one complete cycle of each of the plurality of single musical notes by calculating a shift time between first and second measured sample data points of the plurality of measured sample data points where the one complete cycle of each of the plurality of single musical notes begins, the processor software module applying the shift time to the first measured sample data point such that the first data sample in the extracted data has an amplitude of zero.

10. The synthesizer of claim 9 wherein the processor software module processes successive ones of the plurality of measured data sample points of the one complete cycle of each of the plurality of single musical notes to generate normalized data values that are calculated by interpolating between measured sample data points to determine a data value at the shift time between the successive measured sample data points wherein the data structure stores the normalized data values for the one complete cycle of each of the plurality of single musical notes.

11. The synthesizer of claim 10 wherein the processor software module further determines a normalized amplitude for each of the determined data values at the shift time between the successive measured sample data points by determining an actual range between a greatest positive data value and a greatest negative data value for the measured sample data points and calculating a ratio of a desired range to the actual range, the processor software module adjusting the determined data values at the shift time between the successive measured sample data points by applying the calculated ratio thereto wherein the data structure stores the adjusted determined data values for the one complete cycle of each of the plurality of single musical notes.

12. The synthesizer of claim 8 wherein the data structure is implemented with a database software program.

13. The synthesizer of claim 8 wherein the data structure comprises a note specification data structure containing data related to the one complete cycle of each of the plurality of single musical notes at semi-tone intervals for the selected instrument and a sample value data structure containing the normalized data for the one complete cycle of each of the plurality of single musical notes at semi-tone intervals for the selected instrument.

14. The synthesizer of claim 13 wherein the note specification data structure comprises an instrument name data field to identify the selected musical instrument, a note identification data field to identify a particular one of the plurality of single musical notes, and a data field indicative of the fractional value for the one complete cycle of the particular one of the plurality of single musical notes.

15. The synthesizer of claim 13 wherein the sample value data structure contains an instrument name data field to identify the selected musical instrument, a note identification data field to identify a particular one of the plurality of single musical notes, and a sample data field containing sample data values for the one complete cycle of the particular one of the plurality of single musical notes.

16. The synthesizer of claim 8, further comprising:

a rules data structure to store a set of rules associated with the generation of musical notes;

a user interface operable by a user to select a sequence of musical notes;

a music file generation processor coupled to the user interface and receiving data indicative of the user-selected sequence of musical notes, the generation processor accessing the rules data structure and applying the set of rules to the user-selected sequence of musical notes to thereby generate a musical output file; and a sound board to play the musical output file.

17. The synthesizer of claim 16 wherein the music file generation processor generates a plurality of cycles of a selected one of the sequence of musical notes based on the fractional value associated with the selected one of the sequence of musical notes, with at least a portion of the plurality of cycles being offset in time with respect to the normalized data.

18. A method for creating a software-based music synthesizer, comprising:

sequentially sampling musical sounds corresponding to a single musical note from a selected musical instrument to generate measured digital samples thereof, the measured digital samples containing at least one complete cycle of the single musical note;

analyzing the measured digital samples for the single musical note to extract therefrom one complete cycle of the single musical note;

processing the extracted data to determine the frequency of the one complete cycle of the single musical note to normalize the extracted data such that a first data sample in the extracted data for the one complete cycle of the single musical note has an amplitude of zero;

storing the normalized data for the one complete cycle of the musical note in association with a data identifier; and calculating a fractional value indicative of a timing relationship between the first normalized data sample and a last normalized data sample in the extracted data for the one complete cycle.

19. The method of claim 18, further comprising repeating the process for each of a plurality of single musical notes from the selected musical instrument over a selected range of musical notes, wherein the stored data comprises at least one complete cycle of each of the plurality of single musical notes for the selected musical instrument.

20. The method of claim 18 wherein the one complete cycle of the single musical note is characterized by a plurality of measured sample data points, the method further comprising:

determining a starting point of the one complete cycle of the single musical by calculating a shift time between first and second measured sample data points of the plurality of measured sample data points where the one complete cycle of the single musical note begins; and applying the time shift to the first measured sample data point such that the first sample data point has an amplitude of zero.

21. The method of claim 20, further comprising:

adjusting the data values for successive ones of the plurality of measured data sample points of the one complete cycle of the single musical note to generate adjusted data values that are calculated by interpolating between measured sample data points to determine an adjusted data value at the shift time between the successive measured sample data points wherein the stored normalized data uses the adjusted data values.

22. The method of claim 21, further comprising determining a normalized amplitude by:

determining an actual range between a greatest positive data value and a greatest negative data value for the measured sample data points calculating a ratio of a desired range to the actual range; and further adjusting the determined data values at the shift time between the successive measured sample data points by applying the calculated ratio thereto wherein the stored normalized data values are adjusted in amplitude by the calculated ratio.

23. The method of claim 18 wherein the stored data includes note specification data comprising an instrument name data field to identify the selected musical instrument, a note identification data field to identify the single musical note, and a fractional value data field indicative of the fractional value for the one complete cycle of the single musical note.

24. The method of claim 18 wherein the stored data includes sample data value data comprising an instrument name data field to identify the selected musical instrument, a note identification data field to identify the single musical note, and a sample data field containing sample data values for the one complete cycle of the single musical note.

25. The method of claim 18, further comprising:

storing a set of rules associated with the generation of musical notes;

sensing operation of a user interface operable by a user to select a sequence of musical notes;

applying the set of rules to the user-selected sequence of musical notes to thereby generate a musical output file; and playing the musical output file.

26. The method of claim 25, further comprising generating a plurality of cycles of the single musical note based on the fractional value associated therewith, the first cycle of the plurality of cycles corresponding to the normalized data and subsequent ones of the plurality of cycles being offset in time with respect to the normalized data.

* * * * *